US009617669B2

(12) United States Patent
Fujihara

(10) Patent No.: US 9,617,669 B2
(45) Date of Patent: Apr. 11, 2017

(54) METHOD OF MAKING POLYIMIDE FIBER ASSEMBLY

(75) Inventor: Kan Fujihara, Otsu (JP)

(73) Assignee: KANEKA CORPORATION, Osaka (JP)

( * ) Notice: Subject to any disclaimer, the term of this patent is extended or adjusted under 35 U.S.C. 154(b) by 676 days.

(21) Appl. No.: 12/739,279

(22) PCT Filed: Oct. 20, 2008

(86) PCT No.: PCT/JP2008/068977
§ 371 (c)(1),
(2), (4) Date: Apr. 22, 2010

(87) PCT Pub. No.: WO2009/054349
PCT Pub. Date: Apr. 30, 2009

(65) Prior Publication Data

US 2010/0229517 A1 Sep. 16, 2010

(30) Foreign Application Priority Data

Oct. 26, 2007 (JP) ..... 2007-279368

(51) Int. Cl.
*B01D 39/16* (2006.01)
*D04H 3/03* (2012.01)
(Continued)

(52) U.S. Cl.
CPC ..... *D04H 3/03* (2013.01); *D01D 5/04* (2013.01); *D01D 5/12* (2013.01); *D01D 5/14* (2013.01);
(Continued)

(58) Field of Classification Search
CPC D02G 3/22; D04H 13/00; D04H 5/00; D04H 3/03; D04H 1/42; D04H 3/033;
(Continued)

(56) References Cited

U.S. PATENT DOCUMENTS 3,415,782 A * 12/1968 Irwin et al. ..... 528/188
4,140,509 A 2/1979 Levecque et al.
(Continued)

FOREIGN PATENT DOCUMENTS

EP 0337597 A2 10/1989
EP 0 600 844 6/1994
(Continued)

OTHER PUBLICATIONS

Atul Dahiya, M.G. Kamath, Raghaendra R. Hedge, Spunbond Technology, Apr. 2004.*
(Continued)

*Primary Examiner* — T. Bennett McKenzie
(74) *Attorney, Agent, or Firm* — Nixon & Vanderhye, P.C.

(57) ABSTRACT

A polyimide fiber assembly of the present invention includes polyimide fibers having curved shapes with an average fiber diameter falling within a range of greater than 1 μm to not greater than 100 μm, the polyimide fiber assembly having a bulk density falling within a range of not less than 1 kg/m$^3$ to not greater than 30 kg/m$^3$. This makes it possible to realize a polyimide fiber assembly that is both excellent in thermal insulation performance and sound absorbency and light in weight. The polyimide fiber assembly of the present invention can be obtained by a production method comprising the steps of: (i) discharging a polymeric resin solution obtained by dissolving polyamic acid or polyimide in an organic solvent; and (ii) using external force to cause the polymeric resin solution thus discharged to fly in a direction of the external force, the external force being external force of gas from a direction intersecting with a discharge direction in which the polymeric resin solution is discharged, and then forming a polymeric resin into fibers by spinning while
(Continued)

vaporizing the organic solvent contained in the polymeric resin solution.

2 Claims, 11 Drawing Sheets

(51) Int. Cl.

| | |
|---|---|
| ***D01D 5/04*** | (2006.01) |
| ***D01D 5/12*** | (2006.01) |
| ***D01F 6/74*** | (2006.01) |
| ***D04H 1/42*** | (2012.01) |
| ***D04H 3/033*** | (2012.01) |
| ***D01D 5/14*** | (2006.01) |
| ***D01D 5/23*** | (2006.01) |
| ***D04H 1/4326*** | (2012.01) |

(52) U.S. Cl.
CPC ..... *D01D 5/23* (2013.01); *D01F 6/74* (2013.01); *D04H 1/42* (2013.01); *D04H 1/4326* (2013.01); *D04H 3/033* (2013.01); *Y10T 428/249924* (2015.04); *Y10T 428/298* (2015.01); *Y10T 442/608* (2015.04)

(58) Field of Classification Search
CPC . B01D 39/16; E04B 1/88; D01D 5/04; D01D 5/12; D01F 6/74; Y10T 428/298; Y10T 428/249924; Y10T 442/608
USPC .... 55/522–528; 428/292.1, 298.4, 364, 401; 442/327–417; 181/294; 95/273–287
See application file for complete search history.

(56) References Cited

U.S. PATENT DOCUMENTS

| | | | | |
|---|---|---|---|---|
| 4,346,206 | A * | 8/1982 | Takahashi | C08G 59/4042 525/422 |
| 4,801,502 | A | 1/1989 | Weinrotter et al. | |
| 5,075,068 | A | 12/1991 | Milligan et al. | |
| 5,215,721 | A * | 6/1993 | Tasaki | B60R 21/2644 102/530 |
| 5,229,184 | A | 7/1993 | Campbell et al. | |
| 5,271,889 | A | 12/1993 | Weinrotter et al. | |
| 5,384,390 | A | 1/1995 | Erb, Jr. | |
| 5,439,364 | A * | 8/1995 | Gerking | D04H 3/007 264/210.1 |
| 5,486,412 | A | 1/1996 | Weinrotter et al. | |
| 5,935,512 | A * | 8/1999 | Haynes | D01D 5/098 264/103 |
| 6,383,623 | B1 | 5/2002 | Weinrotter et al. | |
| 6,403,265 | B1 * | 6/2002 | Tanaka | H01M 2/1613 429/142 |
| 6,520,425 | B1 * | 2/2003 | Reneker | 239/294 |
| 6,579,396 | B2 | 6/2003 | Erb, Jr. | |
| 6,692,827 | B2 * | 2/2004 | Luo et al. | 428/369 |
| 2002/0063364 | A1 * | 5/2002 | Taylor | D04H 3/14 264/555 |
| 2003/0045192 | A1 * | 3/2003 | Midkiff | B01D 39/163 442/103 |
| 2003/0203696 | A1 * | 10/2003 | Healey | B01D 39/1623 442/382 |
| 2004/0035095 | A1 * | 2/2004 | Healey | 55/486 |
| 2004/0063369 | A1 * | 4/2004 | Ahn | A44B 18/0011 442/327 |
| 2004/0126579 | A1 * | 7/2004 | Creagan | D01F 8/04 428/373 |
| 2005/0067732 | A1 * | 3/2005 | Kim et al. | 264/172.19 |
| 2005/0160711 | A1 * | 7/2005 | Yang | 55/524 |
| 2005/0245158 | A1 * | 11/2005 | Yahiaoui et al. | 442/118 |
| 2006/0226573 | A1 * | 10/2006 | Stundl | D01D 5/088 264/211.14 |
| 2010/0159770 | A1 * | 6/2010 | Walser | D04H 1/48 442/335 |

FOREIGN PATENT DOCUMENTS

| | | |
|---|---|---|
| JP | 1-292120 | 11/1989 |
| JP | A-1-282374 | 11/1989 |
| JP | 6-257045 A | 9/1994 |
| JP | 2662735 | 6/1997 |
| JP | 10-279680 | 10/1998 |
| JP | 11-200210 | 7/1999 |
| JP | 3133856 | 11/2000 |
| JP | 2002-249927 | 9/2002 |
| JP | 2004-308031 | 11/2004 |
| JP | 3722259 | 9/2005 |
| WO | WO 2005/001187 | 1/2005 |

OTHER PUBLICATIONS

Dahiya et al., "Spunbond Technology," http://www.engr.utk.edu/mse/Textiles/Spunbond%20Technology.htm, updated Apr. 2004 (Spunbond Technology).*
English translation of the International preliminary report on patentability (Chapter 1) of PCT Application No. PCT/JP2008/068977.
International Search Report for PCT/JP2008/068977, mailed Dec. 22, 2008.
European Search Report mailed Dec. 2, 2011, for European Application No. 08841745.6.

* cited by examiner

METHOD OF MAKING POLYIMIDE FIBER ASSEMBLY

This application is the U.S. national phase of International Application No. PCT/JP2008/068977 filed 20 Oct. 2008, which designated the U.S. and claims priority to JP Application No. 2007-279368 filed 26 Oct. 2007, the entire contents of each of which are hereby incorporated by reference.

TECHNICAL FIELD

The present invention relates to: a polyimide fiber assembly; and a sound-absorbing material, a thermal insulating material, a flame-retardant mat, a filter fabric, a heat-resistant garment, a nonwoven fabric, a thermal insulating and sound-absorbing material for use in aircraft, and a heat-resistant bag filter that are obtainable by using such a polyimide fiber assembly.

BACKGROUND ART

Polyimide resins have been used for various purposes because of their heat resistance, flame retardance, chemical resistance, and high electrical insulation reliability. For example, they are high in insulation reliability and environmental stability in the form of films, and as such, they have been widely used as electrical insulating substrates and wire coating materials for use in various mobile phones. Further, they are excellent in abrasion resistance, heat resistance, and chemical resistance in the form of molded products and the like, and as such, they have been used as bearings and the like. Further, polyimide resins have been under research and development in the form of foam, fibers, and the like.

Among them, polyimide fibers are superior in high-temperature stability and chemical resistance to general organic polymeric resin fibers and therefore have been widely used as heat-resistant bag filters for use in exhaust gas treatment (e.g., see Patent Literatures 1 to 3), as a heat-resistant garment (e.g., see Patent Literature 4), and as base materials for various electrical insulating materials (e.g., see Patent Literature 5).

Widely used examples of polyimide fibers are filamentary polyimide fibers spun out of an organic-solvent soluble polyimide resin by a dry spinning method (e.g., see Patent Literatures 6 to 8).

Further known is a thermal insulating and sound-absorbing material for use in aircraft, including: non-thermoplastic fibers; and nodes composed of molten thermoplastic fibers, the nodes surrounding and thereby linking portions of adjoining non-thermoplastic fibers (e.g., see Patent Literatures 9 and 10).

Unfortunately, however, the assemblies of polyimide fibers as disclosed in Patent Literatures 1 to 8 are heavy in weight and insufficient in thermal insulation performance and, sound absorbency.

Specifically, the dry spinning method is a method including the steps of: discharging a spinning solution of a polymeric resin through a spinneret in a vertical direction; dry-removing a solvent from a surface by spinning in a high-temperature drying furnace; and spinning into filaments and winding the filaments. The resulting polyimide fibers are curveless in shape and therefore less likely to become tangled with each other. For this reason, an aggregate of polyimide fibers obtainable by the dry spinning method is high in bulk density, low in amount of air retained therein, and therefore low in thermal insulation performance. Furthermore, the high bulk density leads to an increase in weight of a product obtainable by using such a polyimide fiber aggregate.

Further, although the diameter of spun fibers can be made smaller by raising the draw ratio, such a decrease in diameter of the spun fibers makes the fibers likely to be broken in the middle, thus making the spun fibers lower in yield.

For example, even if polyimide fibers are formed into nonwoven fabric or felt as in the case of the formed article of polyimide fibers as disclosed in Patent Literature 1, the bulk density can only be approximately 0.5 to 1.0 g/cm$^3$ (500 kg/m$^3$ to 1,000 kg/m$^3$).

Furthermore, the thermal insulating and sound-absorbing material for use in aircraft disclosed in Patent Literatures 9 and 10 is inferior in heat resistance.

Specifically, the thermal insulating and sound-absorbing material for use in aircraft disclosed in Patent Literatures 9 and 10 is hard to produce with use of filaments and therefore is formed with use of staples. That is, the thermal insulating and sound-absorbing material for use in aircraft realizes a low density through binding of short non-thermoplastic fibers via nodes composed of molten thermoplastic fibers. For this reason, the density becomes extremely high when the nodes are melted by heat and therefore the binding of the non-thermoplastic fibers is unbound.

CITATION LIST

Patent Literature 1

Japanese Patent No. 3133856 Specification (Publication Date: Feb. 13, 2001)

Patent Literature 2

Japanese Patent No. 3722259 Specification (Publication Date: Nov. 30, 2005)

Patent Literature 3

Japanese Patent No. 2662735 Specification (Publication Date: Oct. 15, 1997)

Patent Literature 4

Japanese Patent Application Publication, Tokukaihei, No. 1-292120 A (Publication Date: Nov. 24, 1989)

Patent Literature 5

Japanese Patent Application Publication, Tokukaihei, No. 11-200210 A (Publication Date: Jul. 2, 1999)

Patent Literature 6

Japanese Patent Application Publication, Tokukosho, No. 63-27444 B (Publication Date: Jun. 3, 1988)

Patent Literature 7

Japanese Patent No. 2935864 Specification (Publication Date: Aug. 16, 1999)

Patent Literature 8

Japanese Patent Application Publication, Tokukaihei, No. 4-257315 A (Publication Date: Sep. 11, 1992)

Patent Literature 9

U.S. Pat. No. 6,383,623 Specification (Publication Date: May 7, 2002)

Patent Literature 10

U.S. Pat. No. 6,579,396 Specification (Publication Date: Jun. 17, 2003)

SUMMARY OF INVENTION

The present invention has been made in view of the foregoing problems, and it is an object of the present invention to realize: a polyimide fiber assembly that is both excellent in thermal insulation performance and sound absorbency and light in weight in addition to having such properties of polyimide fibers as being excellent in flame retardance, heat resistance, and chemical resistance; and a sound-absorbing material, a thermal insulating material, a flame-retardant mat, a filter fabric, a heat-resistant garment, a nonwoven fabric, a thermal insulating and sound-absorbing material for use in aircraft, and a heat-resistant bag filter that are obtainable by using such a polyimide fiber assembly.

As a result of their long year of diligent study to solve the foregoing problems, the inventors have found that a polyimide fiber assembly including polyimide fibers having curved shapes with an average fiber diameter falling within a range of greater than 1 μm to not greater than 100 μm, the polyimide fiber assembly having a bulk density falling within a range of 1 kg/m$^3$ to 30 kg/m$^3$, can be produced by a production method including the steps of: (i) discharging a polymeric resin solution obtained by dissolving polyamic acid or polyimide in an organic solvent; and (ii) using external force to cause the polymeric resin solution thus discharged to fly in a direction of the external force, the external force being external force of gas from a direction intersecting with a discharge direction in which the polymeric resin solution is discharged, and then forming a polymeric resin into fibers by spinning while vaporizing the organic solvent contained in the polymeric resin solution. Based on these findings, the inventors have finally accomplished the present invention.

Thus, the inventors have found that such a polyimide fiber assembly can be suitably used as a sound-absorbing material, a thermal insulating material, a flame-retardant mat, a heat-resistant garment, a thermal insulating and sound-absorbing material for use in aircraft, a filter fabric composed of highly heat-resistant fibers, a nonwoven fabric, and a heat-resistant bag filter, although glass fibers have been mainly used as such. Based on these findings, the inventors have finally accomplished the present invention.

That is, in order to solve the foregoing problems, a polyimide fiber assembly of the present invention includes polyimide fibers having curved shapes with an average fiber diameter falling within a range of greater than 1 μm to not greater than 100 μm, the polyimide fiber assembly having a bulk density falling within a range of not less than 1 kg/m$^3$ to not greater than 30 kg/m$^3$.

This brings about an effect of making it possible to provide a polyimide fiber assembly that is both excellent in thermal insulation performance and sound absorbency because of its large amount of air retained therein and light in weight in addition to having such properties of the polyimide fibers as being excellent in flame retardance, heat resistance, and chemical resistance.

Since the average fiber diameter falls within a range of greater than 1 μm to not greater than 100 μm, the fibers exhibit an appropriate level of elasticity, easily return to their original shapes even after they have been under load, and therefore can stably retain such a shape as to exhibit the bulk density. That is, when the average fiber diameter is not greater than 1 μm, the fibers become less resilient to external force and therefore cannot retain such a shape as to exhibit the bulk density, even if the bulk density falls within the range. Alternatively, when the average fiber diameter exceeds 100 μm, a bulk density falling within the range leads to degradation in heat insulation performance and sound absorbency.

The polyimide fiber assembly according to the present invention is preferably structured such that the polyimide fibers include at least non-thermoplastic polyimide fibers.

Further, the polyimide fiber assembly according to the present invention is preferably obtainable by a production method including the steps of: (i) discharging a polymeric resin solution obtained by dissolving polyamic acid or polyimide in an organic solvent; and (ii) using external force to cause the polymeric resin solution thus discharged to fly in a direction of the external force, the external force being external force of gas from a direction intersecting with a discharge direction in which the polymeric resin solution is discharged, and then forming a polymeric resin into fibers by spinning while vaporizing the organic solvent contained in the polymeric resin solution.

The polyimide fiber assembly according to the present invention is preferably structured such that at least some of the polyimide fibers bind with each other while keeping their fibrous shapes.

This structure is likely to lead to a low bulk density and brings about such further effects as improvements in elasticity and cohesiveness of the fibers.

The polyimide fiber assembly according to the present invention is preferably structured to further include a binder resin, wherein at least some of the polyimide fibers bind with each other through the binder resin.

This structure is likely to lead to a low bulk density and brings about such further effects as improvements in elasticity and cohesiveness of the fibers.

In order to solve the foregoing problems, a sound-absorbing material according to the present invention is obtainable by using such a polyimide fiber assembly according to the present invention.

This structure makes it possible provide a sound-absorbing material that is obtainable by using such a polyimide fiber assembly according to the present invention and therefore both excellent in sound absorbency and light in weight.

Further, in order to solve the foregoing problems, a thermal insulating material according to the present invention is obtainable by using such a polyimide fiber assembly according to the present invention.

This structure makes it possible provide a thermal insulating material that is obtainable by using such a polyimide fiber assembly according to the present invention and therefore both excellent in thermal insulation performance and light in weight in addition to having such properties of the polyimide fibers as being excellent in flame retardance, heat resistance, and chemical resistance.

Further, in order to solve the foregoing problems, a flame-retardant mat according to the present invention is obtainable by using such a polyimide fiber assembly according to the present invention.

This structure makes it possible provide a flame-retardant mat that is obtainable by using such a polyimide fiber assembly according to the present invention and therefore both excellent in thermal insulation performance and sound absorbency and light in weight in addition to having such properties of the polyimide fibers as being excellent in flame retardance, heat resistance, and chemical resistance.

Further, in order to solve the foregoing problems, a filter fabric according to the present invention is obtainable by using such a polyimide fiber assembly according to the present invention.

This structure makes it possible provide a filter fabric that is obtainable by using such a polyimide fiber assembly according to the present invention and therefore light in weight in addition to having such properties of the polyimide fibers as being excellent in flame retardance, heat resistance, and chemical resistance.

Further, in order to solve the foregoing problems, a heat-resistant garment according to the present invention is obtainable by using such a polyimide fiber assembly according to the present invention.

This structure makes it possible provide a heat-resistant garment that is obtainable by using such a polyimide fiber assembly according to the present invention and therefore both excellent in thermal insulation performance and light in weight in addition to having such properties of the polyimide fibers as being excellent in flame retardance, heat resistance, and chemical resistance.

Further, in order to solve the foregoing problems, a nonwoven fabric according to the present invention is obtainable by using such a polyimide fiber assembly according to the present invention.

This structure makes it possible provide a nonwoven fabric that is obtainable by using such a polyimide fiber assembly according to the present invention and therefore both excellent in thermal insulation performance and sound absorbency and light in weight in addition to having such properties of the polyimide fibers as being excellent in flame retardance, heat resistance, and chemical resistance.

Further, in order to solve the foregoing problems, a thermal insulating and sound-absorbing material for use in aircraft according to the present invention is obtainable by using such a polyimide fiber assembly according to the present invention.

This structure makes it possible provide a thermal insulating and sound-absorbing material for use in aircraft that is obtainable by using such a polyimide fiber assembly according to the present invention and therefore both excellent in thermal insulation performance and sound absorbency and light in weight in addition to having such properties of the polyimide fibers as being excellent in flame retardance, heat resistance, and chemical resistance.

Further, in order to solve the foregoing problems, a heat-resistant bag filter according to the present invention is obtainable by using such a polyimide fiber assembly according to the present invention.

This structure makes it possible provide a heat-resistant bag filter that is obtainable by using such a polyimide fiber assembly according to the present invention and therefore light in weight in addition to having such properties of the polyimide fibers as being excellent in flame retardance, heat resistance, and chemical resistance.

BRIEF DESCRIPTION OF DRAWINGS

FIG. 1 is a pattern diagram schematically showing the configuration of a production apparatus that is used in a method according to the present embodiment for producing polyimide fibers.

FIG. 2 is a plan view for explaining an angle of intersection between a discharge direction in which a polymeric resin solution is discharged and a direction of the airflow in FIG. 1.

FIG. 3 is a pattern diagram schematically showing the configuration of another production apparatus that is used in the method according to the present embodiment for producing polyimide fibers.

FIG. 4 shows an electron micrograph of polyimide fibers obtained in Example 1.

FIG. 5 shows an electron micrograph of polyimide fibers obtained in Example 2.

FIG. 6 shows an electron micrograph of polyimide fibers obtained in Example 3.

FIG. 7 shows an electron micrograph of polyimide fibers obtained in Example 4.

FIG. 9 is a cross-sectional view of an example of a spinning die (spinneret) that can be used in the present embodiment.

FIG. 10 shows an electron micrograph of polyimide fibers obtained in Example 5.

FIG. 11 shows an electron micrograph of the polyimide fibers obtained in Example 5.

FIG. 12 shows an electron micrograph of polyimide fibers obtained in Example 6.

FIG. 13 shows an electron micrograph of the polyimide fibers obtained in Example 6.

REFERENCE SIGNS LIST

Figure 1:
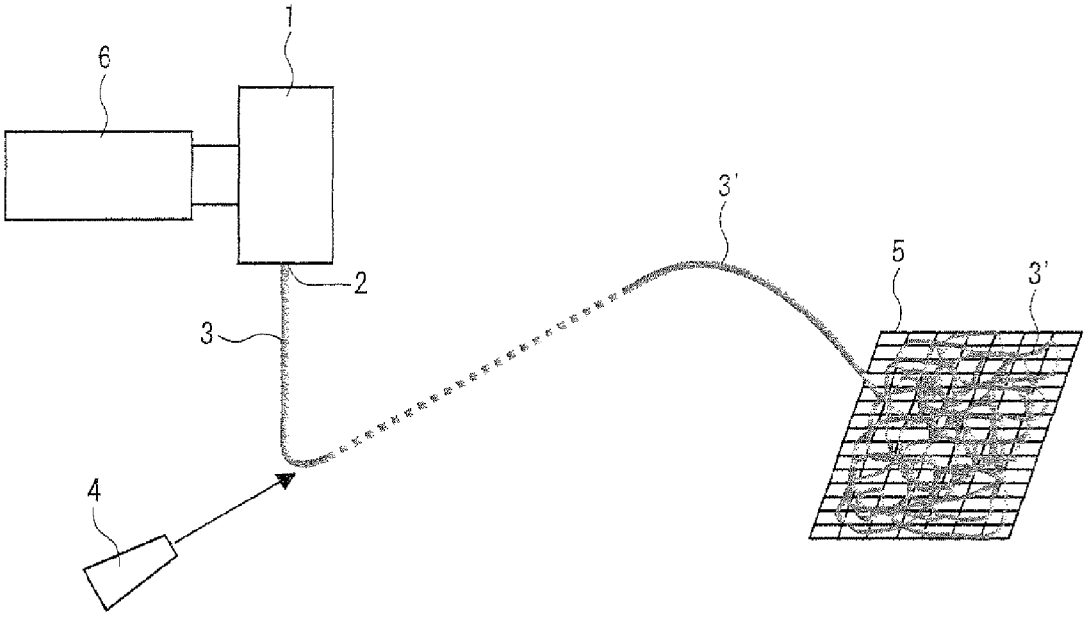
FIG. 1

1 Spinneret (discharging means)
2 Orifice
3 Polymeric resin solution
3' Fibrous polymeric resin
4 Airflow generating means
5 Catching means
6 Polymeric resin solution tank
10 Belt conveyor (catching means)
12 Drying and calcining furnace (heating means)
13 Winding device
$d_d$ Discharge direction
$d_a$ Airflow direction
θ Angle of intersection
50 Tangent drawn to a straight line preceding the start of a change in storage modulus of elasticity
51 Tangent drawn to a straight line following the end of the change in storage modulus of elasticity

52 Point of intersection (Temperature at which the storage modulus of elasticity inflects)

53 Temperature at which the tan δ value reaches its peak

20 Inlet for a polymeric resin solution (A-1)

21 Inlet for a polymeric resin solution (B-1) or a polymeric resin solution (B-2)

22 Die

23 Branching channel

24 Branching channel

25 Orifice for the polymeric resin solution (A-1)

26 Orifice for the polymeric resin solution (B-1) or the polymeric resin solution (B-2)

DESCRIPTION OF EMBODIMENTS

The present invention is described below in detail. In this specification, the term "weight" is regarded as a synonym of the term "mass", and the term "% by weight" is regarded as a synonym of the term "% by mass". Further, the range "A to B" means a range of not less than A to not greater than B, and the unit of viscosity "P" means poise.

Further, the term "polyimide fibers" in this specification means fibers constituted by a polymeric compound having an imide bond in the molecule.

A method according the present invention for producing polyimide fibers is described with reference to FIGS. 1 through 3.

FIG. 1 is a pattern diagram schematically showing the configuration of a production apparatus that is used in the method according to the present embodiment for producing polyimide fibers.

As shown in FIG. 1, the apparatus, which is used in the method according to the present embodiment for producing polyimide fibers, includes: a spinneret (discharging means) 1 through which a polymeric resin solution 3 obtained by dissolving polyamic acid or polyimide in an organic solvent is discharged; airflow generating means 4 for blowing gas onto the polymeric resin solution 3 thus discharged and thereby causing the polymeric resin solution 3 to fly in a direction of the airflow, the gas being blown from a direction intersecting with a discharge direction in which the polymeric resin solution 3 is discharged; and catching means 5 for catching the polymeric resin. The apparatus further includes a polymeric resin solution tank 6 for storing the polymeric resin solution 3.

Further, the method according to the present embodiment for producing polyimide fiber includes the steps of: (i) discharging, from a direction intersecting with the discharge direction, a polymeric resin solution 3 obtained by dissolving a polymeric resin in an organic solvent; (ii) using external force of gas to cause the polymeric resin solution 3 thus discharged to fly in a direction of the external force, and then forming the polymeric resin into fibers by spinning while vaporizing the organic solvent contained in the polymeric resin solution 3; and (iii) heating the fibrous polymeric resin after the forming step (ii).

(I) Discharging Step

The discharging step is a step of discharging the polymeric resin solution 3 and, specifically, can be executed by discharging the polymeric resin solution 3 through an orifice 2 of the spinneret 1.

The shape, number, and size of orifices 2 that are provided in the spinneret 1 may be appropriately set according to the type, diameter, length, etc. of fibers to be produced. For example, it is possible to use such a spinneret 1 provided with a single circular orifice having a diameter falling within a range of 0.1 mm to 1.5 mm.

The discharge rate is not particularly limited as long as the polymeric resin solution 3 thus discharged can be made in the after-mentioned forming step to fly in the direction of the external force, and can be set to fall within a range of 0.001 to 10.000 g/min/hole, for example.

Further, the discharge direction is not particularly limited as long as the polymeric resin solution 3 thus discharged can be made to fly in the direction of the external force, and may be either a direction of gravitational force as shown in FIG. 1 or a direction different from the direction of gravitational force.

It is preferable that before the polymeric resin solution 3 is discharged, the viscosity of the polymeric resin solution 3 fall within a range of not less than 10 P to not greater than 50,000 P, more preferably not less than 50 P to not greater than 10,000 P, even more preferably not less than 500 P (more preferably 1,000 P) to not greater than 10,000 P or not less than 100 P to not greater than 6,000 P, even more preferably not less than 1,000 P to not greater than 6,000 P, especially preferably not less than 1,000 P to not greater than 4,000 P, or most preferably not less than 1,500 P to not greater than 4,000 P, as measured by using a type B viscometer at a solution temperature of 23° C. with a rotor No. 7 at 2 rpm.

In this specification, the term "viscosity" means a value measured by a method described later in Examples. It is preferable that the viscosity of the polymeric resin solution be adjusted to fall within the range, because such an adjustment makes it easy to draw out the fibers into fine fibers in using the external force of gas in the after-mentioned forming step to cause the polymeric resin solution 3 thus discharged to fly.

Furthermore, from the point of view of making it easy for the polymeric resin solution 3 to be drawn out by the external force into the shape of fibers, it is preferable that the polymeric resin solution 3 have a thixotropic index of not less than 1.0 to not greater than 1.5, as measured by a method described later in Examples.

(II) Forming Step

The forming step is a step of forming the polymeric resin into fibers by spinning while vaporizing the organic solvent contained in the polymeric resin solution 3 by using external force of gas to cause the polymeric resin solution 3 thus discharged to fly in a direction of the external force. The present embodiment forms the polymeric resin into fibers by spinning while vaporizing the organic solvent contained in the polymeric resin solution 3 by blowing gas from a direction intersecting with the discharge direction and thereby causing the polymeric resin solution 3 thus discharged to fly in a direction of the airflow (gas thus blown).

The term "fly" here means moving through the air to a distant place (i.e., a place different from the place where the polymeric resin solution 3 would be located in the absence of the external force or, more specifically, a place different from the place onto which the polymeric resin solution 3 would fall in the absence of the external force with only gravity acting thereon. For example, the step in the dry spinning method of vaporizing a solvent by blowing airflow onto a polymeric resin solution does not fall under the category of "fly" in this specification, because the polymeric resin solution does not move to a distant place.

Further, on the "fly", a liquid flow of the polymeric resin solution 3 may either be broken by the airflow or move to a distant place through the air as a single continuous liquid flow without breakage. Both of the arrangements are encompassed in the scope of "fly".

Further, on the "fly", the liquid flow of the polymeric resin solution 3 is drawn out by the airflow and, at the same time, formed into the fibers of the polymeric resin by the volatilization of the solvent. For this reason, the length of the fibers thus obtained is affected by the length of the liquid flow.

In the present embodiment, a greater length of the resulting polyimide fibers results in greater entanglement of fibers and therefore a lower bulk density. For this reason, it is preferable that on the "fly", the length of the liquid flow of the polymeric resin solution 3 be at least not less than 1 cm, more preferably not less than 5 cm, or even more preferably not less than 10 cm.

Furthermore, the phrase "cause . . . to fly in a direction of the external force" in this specification means causing the polymeric resin solution 3 to fly in direction different from the discharge direction, and this specification excludes causing the polymeric resin solution 3 to fly in a direction identical to the discharge direction. In other words, the phrase "cause . . . to fly in a direction of the external force" means causing the polymeric resin solution 3 to fly in a direction in which it would not fly in the absence of the external force.

That is, for example, the step in the dry spinning method of vaporizing a solvent by blowing airflow onto a polymeric resin solution from a direction identical to a discharge direction does not fall under the category of "cause . . . to fly in a direction of the external force" in this specification, because the polymeric resin solution does not fly in a direction in which it would not fly in the absence of the external force.

As shown in FIG. 1, in the forming step according to the present embodiment, by blowing gas onto the polymeric resin solution 3, which has been discharged through the orifice 2 to fall downward from the orifice 2, from the airflow generating means 4 so that the gas intersects with the flow of the polymeric resin solution 3, the polymeric resin solution 3 is made to fly in a flow direction of the gas. Thus, the polymeric resin is formed into fibers by spinning while the organic solvent contained in the polymeric resin solution 3 is being vaporized from a surface of the polymeric resin solution 3.

The airflow generating means 4 is not particularly limited as long as it is means capable of blowing gas to cause the polymeric resin solution 3 to fly in a flow direction of the gas, and usable examples thereof include an air nozzle, a slit nozzle, and a blower nozzle.

Further, the type of gas that is blown by the airflow generating means 4 is not particularly limited, but is preferably air, nitrogen, oxygen, argon, or helium. It is possible to use any one of these gases alone, or two or more of them in combination. Further, these gasses may contain various solvents and/or water.

Further, it is preferable that the flow velocity of the gas that is discharged from the airflow generating means 4 fall within a range of not less than 1 m/sec to not greater than 400 m/sec. For a smaller fiber diameter, it is more preferable that the flow rate fall within a range of not less than 10 m/sec to not greater than 300 m/sec. That is, it is preferable that the flying speed of the polymeric resin solution 3 fall within a range of not less than 1 m/sec to not greater than 400 m/sec, or more preferably not less than 10 m/sec to not greater than 300 m/sec.

Further, it is preferably that the distance of the airflow generating means 4 from the orifice 2 be appropriately selected according to the flight condition of the polymeric resin solution 3, the diameter of the spun fibers, and the like. That is, it is preferable that the distance be at least not less than 0.5 cm, or more preferably at least not less than 1 cm. In order for the polymeric resin solution 3 to be stabilized for easy spinning, it is even more preferable that the distance be not less than 10 cm. Further, it is undesirable that the distance be shorter than 1 cm or, more particularly, 0.5 cm, because such a short distance results in unstable spinning.

The term "direction intersecting with a discharge direction" in this specification means a direction that can intersects with a discharge direction in which the polymeric resin solution 3 is discharged, the angle at which the direction intersects with the discharge direction (angle of intersection) is not limited to 90 degrees, and is not particularly limited as long as it is not 0 degrees or 180 degrees.

Figure 2:
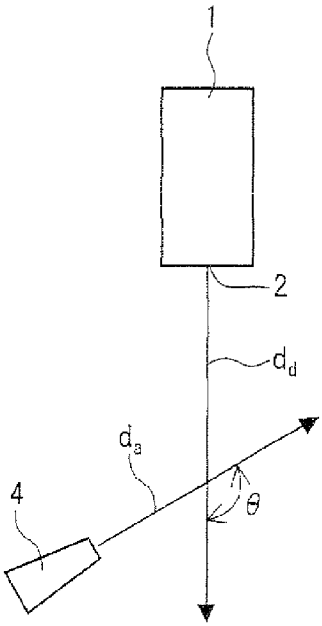
FIG. 2
Figure 3:
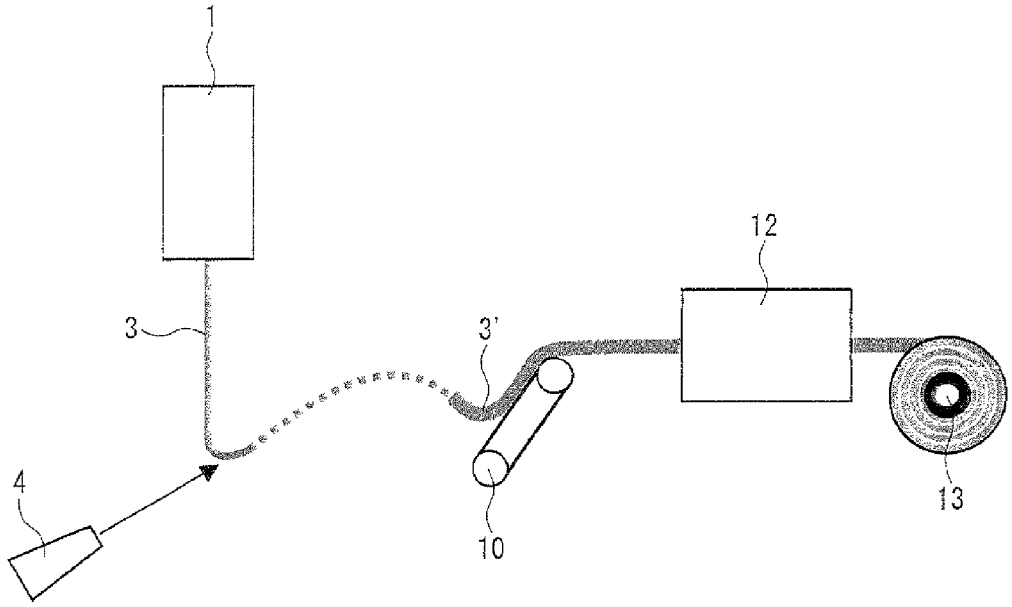
FIG. 3

Further, as shown in FIG. 2, the "angle of intersection" means the angle θ between the discharge direction $d_d$ of the polymeric resin solution 3 and the airflow direction $d_a$ from the airflow generating means 4.

It is preferable that the angle of intersection θ fall within a range of not less than 30 degrees to not greater than 150 degrees. Control of the angle of intersection θ within the range leads to an increase in time of flight of the polymeric resin solution 3 and therefore efficient removal of the organic solvent from the surface of the polymeric resin solution 3.

Further, it is more preferable that the angle of intersection θ fall within a range of not less than 40 degrees to not greater than 140 degrees, or most preferably not less than 60 degrees to not greater than 135 degrees. Control of the angle of intersection θ within the range leads to an increase in fiber length of a fibrous polymeric resin obtainable by the flight of the polymeric resin solution 3. This makes it possible to spin polyimide fibers out of the fibrous polymeric resin so that the average fiber diameter of a fiber assembly of the resultant polyimide fibers is controlled within a range of greater than 1 μm to not greater than 100 μm.

Further, since the polymeric resin solution 3 thus discharged is blown with the airflow from one direction, there occur variations in dryness of the polymeric resin solution 3. Specifically, because that surface of the polymeric resin solution 3 which is in contact with the airflow dries faster than a surface (back surface) opposite to that surface, the forming step gives a polymeric resin 3' that varies in dryness between that surface of the polymeric resin 3' which is in contact with the airflow and a surface (back surface) opposite to that surface. This causes positional variations in contraction stress that is caused in the polymeric resin 3' when the solvent is volatilized in the after-mentioned heating step, and such variations in contraction stress result in curved fibers.

Although it is difficult to control such a state of being curved, curved fibers can be efficiently produced by employing a spinning method of the present embodiment. Moreover, an assembly of such fibers has a lower bulk density because of greater entanglement of fibers.

It should be noted that the polymeric resin solution 3, blown with the gas from the direction intersecting with the discharge direction $d_d$, flies in the intersecting airflow direction $d_a$. That is, it is preferable that the polymeric resin solution 3 flies in a direction within a range of not less than 30 degrees to not greater than 150 degrees with respect to the discharge direction $d_d$ of the polymeric resin solution 3 before the forming step.

Further, the fibrous polymeric resin 3' can be made finer by further blowing the gas onto the polymeric resin solution 3 while the polymeric resin solution 3 is flying. The fibrous polymeric resin 3' can be drawn out into finer fibers by again blowing the gas along the line of flight of the polymeric resin solution 3.

It is preferable that the temperature of the airflow that is used in the forming step fall within a range of −100° C. to 300° C., more preferably −50° C. to 200° C., or especially preferably 0° C. to 100° C. With the temperature of the airflow within the range, it becomes possible to cause the polymeric resin solution 3 to fly stably. Further, because the organic solvent contained in the polymeric resin solution 3 is efficiently scattered during the flight, it becomes easy to form the polymeric resin 3' into fibers.

Further, in the present embodiment, when the polymeric resin solution 3 is a polyamic acid solution having a polyamic acid solution dissolved therein, the polyamic acid resin contained in the polymeric resin 3' may be partially imidized by heat from the airflow. That is, the fibrous polymeric resin 3' may be fibers composed of polyamic acid, and the polyamic acid fibers may partially become polyimide fibers.

Further, in the method according to the present embodiment for producing polyimide fibers, it is preferable that the concentration of the organic solvent with respect to the solid content of the fibrous polymeric resin 3' after the forming step fall within a range of not less than 1% by mass to not greater than 200% by mass, more preferably not less than 5% by mass to not greater than 150% by mass, even more preferable not less than 10% by mass to not greater than 100% by mass, or especially preferably not less than 10% by mass to not greater than 80% by mass. It is preferable that the concentration of the solvent with respect to the solid content be set in such a condition, because such a setting makes it possible to inhibit the fibrous polymeric resin 3' from being dissolved again by the internal solvent and thereby stabilize the bulk density.

For this reason, it is preferable that such conditions as the flow velocity, flow rate, and temperature of the gas that is blown in causing the polymeric resin solution 3 to fly to become the fibrous polymeric resin 3', and the flying distance of the polymeric resin solution 3 be appropriately selected so that the concentration of the solvent in the fibrous polymeric resin 3' after the forming step falls within the range.

It is preferable that the concentration of the organic solvent with respect to the solid content of the polymeric resin 3' after the forming step be adjusted to fall within the range, because such an adjustment makes it possible to freely choose between allowing fibrous substances to bind with each other and preventing them from binding with each other.

The concentration (% by mass) of the solvent with respect to the solid content can be calculated according to the following formula:

$$\text{Concentration of Solvent with Respect to Solid Content} = (A-B) \div B \times 100,$$

where A is the mass of the fibrous polymeric resin 3' as collected and B is the mass of the resin from which the solvent has been completely removed by heating the fibrous substance at such a temperature and for such a period of time that the solvent is completely scattered.

(III) Catching Step

The method according to the present embodiment for producing polyimide fibers further includes the step of catching the fibrous polymeric resin 3'. The term "catching" in this specification means capturing and collecting the fibrous polymeric resin 3' during the flight.

In the catching step of the present embodiment, the fibrous polymeric resin 3' obtained by the forming step is caught by the catching means 5 as shown in FIG. 1. Examples of the catching means 5 include a flat plate or container having a reticulated opening. Further, the catching means 5 is not limited to a device having an immovable catching surface, and may be a device, such as a belt conveyor, which has a movable catching surface.

When the polymeric resin 3' is caught by the immovable catching surface of the catching means 5, the polymeric resin 3' can be caught as a fiber assembly. Alternatively, when the polymeric resin 3' is caught by the movable catching surface of the catching means 5, the polymeric resin 3' can be caught as a nonwoven fabric having a given thickness.

Further, it is possible to apply a resin solution different from the polymeric resin solution 3 while the polymeric resin solution 3 is flying. For example, it is possible to control the adhesiveness, etc. of surfaces of the spun fibers by applying a fluoropolymer or the like.

Further, it is possible to obtain monofilamentary polyimide fibers by using a winding device to wind the fibrous polymeric resin 3' in flight.

(IV) Heating Step (Imidizing Step)

The method according to the present embodiment for producing polyimide fibers further includes the step of heating the fibrous polymeric resin 3' thus caught.

A temperature for the heating may be appropriately selected according to the type of organic solvent contained and/or the temperature required for imidizing the polymeric resin 3' into a polyimide resin. For example, it is preferable that the fibrous polymeric resin 3' be heated within a temperature range of not lower than 50° C. to not higher than 700° C., or more preferably not lower than 100° C. to not higher than 600° C.

When the resulting polyimide fibers are non-thermoplastic polyimide fibers composed of a non-thermoplastic polyimide resin, it is preferable that the highest temperature at which the fibrous polymeric resin 3' is heated be not lower than 400° C., because such a temperature enables complete imidization.

Further, when the polyimide fibers are thermoplastic polyimide fibers, it is preferable that the highest temperature at which the fibrous polymeric resin 3' is heated be a temperature 100° C. higher than the glass-transition temperature of the resulting polyimide fibers, or more preferably a temperature 50° C. higher than the glass-transition temperature, because such a temperature makes it possible to finish imidization completely and to suppress thermal melting of the polyimide fibers.

Further, the heating temperature may either be constant or vary within the range. In particular, it is preferable that the fibrous polymeric resin 3' be calcined first at a lower temperature and then at a higher temperature. After the calcination, the fibrous polymeric resin 3' may be either rapidly or gradually cooled down. Further, it is preferable that the heating time be appropriately selected.

Further, for example, when the polymeric resin solution 3 is a solution containing polyamic acid containing at least pyromellitic acid dianhydride and 4,4-diaminodiphenylether as raw materials, it is preferable that the final calcination temperature be set at not lower than 400° C., because such a setting makes it possible to increase the rate of imidization reaction of the polyamic acid to nearly 100%.

Although the foregoing has described a method for batch production of polyimide fibers, the scope of present invention is not limited to this. For example, as shown in FIG. 3, the method according to the present embodiment for producing polyimide fibers may be a method for continuous production of a roll of polyimide fibers, including the steps of: discharging a polymeric resin solution 3 through a spinneret 1; forming the polymeric resin solution 3 into a fibrous polymeric resin 3' by using airflow generating means 4 to cause the polymeric resin solution 3 to fly; continuously catching the fibrous polymeric resin 3' on a belt conveyor 10, constituted by a belt having a reticulated surface, which is moving slowly; removing the fibrous polymeric resin 3' from the belt conveyor 10; conveying the fibrous polymeric resin 3' to a drying and calcining furnace 12; and heating, drying, and calcining the fibrous polymeric resin 3'; and winding the fibrous polymeric resin 3'.

Further, although the foregoing has described a method that includes a catching step and uses a production apparatus including catching means 5, the scope of the present invention is not limited to this. The production apparatus does not need to include the catching means 5, and the production method does not need to include the catching step.

In this case, for example, substantially the same effects as those of the present embodiment are obtained by collecting the fibrous polymeric resin 3' that has fallen after the flight. However, in such a case as the present embodiment where a catching step or catching means is included, it is possible to efficiently collect a fibrous polymeric resin.

Furthermore, although the foregoing has described a production method including a heating step, the scope of the present invention is not limited to this. For example, when the polymeric resin solution used is such a polyimide solution as will be described below and the organic solvent is sufficiently removed during the flight in the forming step, it is not necessary to provide a separate heating step, nor is it necessary to provide the production apparatus with heating means.

(V) Polymeric Resin Solution

Examples of the organic solvent that constitutes the polymeric resin solution include: organic polar amide-based solvents such as N,N-dimethylformamide, N,N-dimethylacetoamide, N-methyl-2-pyrrolidone, and γ-butyrolactone; water-soluble ether compounds such as tetrahydrofuran, dioxane, and dioxolane; water-soluble alcohol-based compounds such as propylene glycol and ethylene glycol; water-soluble ketone-based compounds such as acetone and methyl ethyl ketone; and water-soluble nitrile compounds such as acetonitrile and propionitrile. These solvents may be either used alone or used as a mixed solvent of two or more of them. Among these organic solvents, it is preferable, from the point of view of solubility, that N,N-dimethylformamide, N,N-dimethylacetoamide; and/or N-methyl-2-pyrrolidone be used.

The polymeric resin contained in the polymeric resin solution is polyamic acid and/or polyimide. The polyamic acid and/or polyimide is not particularly limited in structure. For example, suitably usable examples of acid dianhydrides that serve as raw material for the polyamic acid and/or polyimide include 2,2-bis[4-(3,4-dicarboxyphenoxy)phenyl]propane dianhydride, 2,2-bis[4-(3,4-dicarboxyphenoxy)phenyl]hexafluoropropane dianhydride, 2,2-bis(4-hydroxyphenyl)propanedibenzoate-3,3',4,4'-tetracarb oxylic acid dianhydride, 3,3',4,4'-biphenyl tetracarboxylic acid dianhydride, 2,3,3',4-biphenyl tetracarboxylic acid dianhydride, 2,2'-hexafluoropropylidenediphthalic acid dianhydride, 3,3',4,4'-benzophenone tetracarboxylic acid dianhydride, 4,4'-oxydiphthalic acid dianhydride, 3,3',4,4'-diphenylsulfontetracarboxylic acid dianhydride, pyromellitic acid dianhydride, 1,2,5,6-naphthalene tetracarboxylic acid dianhydride, 2,3,6,7-naphthalene tetracarboxylic acid dianhydride, cyclobutane tetracarboxylic acid dianhydride, methylcyclobutane tetracarboxylic acid dianhydride, and 1,2,3,4-tetracarboxybutane dianhydride. Use of these raw materials makes it possible to improve the heat resistance of the polyimide fibers.

Further, examples of diamines that serve as raw material for the polyamic acid and/or polyimide include 4,4'-diaminodiphenylether, 3,3'-diaminodiphenylether, 3,4-diaminodiphenylether, m-phenylenediamine, p-phenylenediamine, bis[4-(4-aminophenoxy)phenyl]sulfone, (4-aminophenoxyphenyl)(3-aminophenoxy)phenyl]sulfone, bis[4-(3-aminophenoxy)phenyl]sulfone, 3,3'-diaminobenzanilide, 3,4'-diaminobenzanilide, 4,4'-diaminobenzanilide, bis[4-(3-aminophenoxy)phenyl]methane, bis[4-(4-aminophenoxy)phenyl]methane, [4-(4-aminophenoxyphenyl][4-(3-aminophenoxyphenyl)]methane, 1,1-bis[4-(3-aminophenoxy)phenyl]ethane, 1,1-bis[4-(4-aminophenoxy)phenyl]ethane, 1,1-[4-(4-aminophenoxyphenyl)][4-(3-aminophenoxyphenyl)]ethane, 1,2-bis[4-(3-aminophenoxy)phenyl]ethane, 1,2-bis[4-(4-aminophenoxy)phenyl]ethane, 1,2-[4-(4-aminophenoxyphenyl)][4-(3-aminophenoxyphenyl)]ethane, 2,2-bis[4-(3-aminophenoxy)phenyl] propane, 2,2-bis[4-(4-aminophenoxy)phenyl]propane, 2,2-[4-(4-aminophenoxy)phenyl][4-(3-aminophenoxy)phenyl]propane, 2,2-bis[3-(3-aminophenoxy)phenyl]-1,1,1,3,3,3-hexafluoropropane, 2,2-bis[4-(4-aminophenoxy)phenyl]-1,1,1,3,3,3-hexafluoropropane, 2,2-[4-(4-aminophenoxy)phenyl][4-(3-aminophenoxy)phenyl]-1,1,1,3,3,3-hexafluoropropane, 1,4-bis(3-aminophenoxy)benzene, 1,4-bis(4-aminophenoxy)benzene, 1,3-bis(3-aminophenoxy)benzene, 1,3-bis(4-aminophenoxy)benzene, 4,4'-bis(4-aminophenoxy)biphenyl, 4,4'-bis(3-aminophenoxy)biphenyl, bis[4-(3-aminophenoxy)phenyl]ketone, bis[4-(4-aminophenoxy)phenyl]ketone, bis[4-(3-aminophenoxy)phenyl]ether, bis[4-(4-aminophenoxy)phenyl]ether, polytetramethyleneoxide-di-P-aminobenzoate, poly(tetramethylene/3-methyltetramethyleneether)glycol bis (4-aminobenzoate), trimethylene-bis(4-aminobenzoate), p-phenylene-bis(4-aminobenzoate), m-phenylene-bis(4-aminobenzoate), and bisphenol A-bis(4-aminobenzoate). Appropriate concomitant use of these diamines leads to improvements in the upper temperature limit, chemical resistance, etc. of the resultant polyimide fibers.

In the present embodiment, the polyamic acid and/or polyimide solution can be obtained as the polymeric resin solution by appropriately selecting any of the acid dianhydrides and any of the diamines and polymerizing them in the organic solvent.

In order to further improve the heat resistance and chemical resistance of the resultant polyimide fibers, it is especially preferable that among the acid dianhydrides, aromatic acid dianhydrides, i.e., pyromellitic acid dianhydride, 3,3'4,4'-biphenyl tetracarboxylic acid dianhydride, and 3,3'4,4'-benzophenone tetracarboxylic acid dianhydride be used.

Furthermore, it is especially preferable that among the diamines, aromatic diamines, i.e., 4,4'-diaminodiphenylether, 3,4-diaminodiphenylether, m-phenylenediamine, p-phenylenediamine, bis[4-(4-aminophenoxy)phenyl]sulfone, bis[4-(3-aminophenoxy)phenyl]sulfone, bis[4-(4-aminophenoxy)phenyl]methane, 2,2-bis[4-(4-aminophenoxy)phenyl] propane, 2,2-bis[4-(3-aminophenoxy)phenyl] propane, and 1,3-bis(3-aminophenoxy)benzene be used.

Furthermore, it is possible to concomitantly use a diamino compound having either a carboxyl or hydroxyl group as a side chain of such a diamine. Examples of such a diamino compound having either a carboxyl or hydroxyl group as a side chain include 2,4-diaminobenzoic acid, 2,5-diaminobenzoic acid, 3,5-diaminobenzoic acid, 3,3'-diamino-4,4'-dicarboxybiphenyl, 4,4'-diamino-3,3'-dicarboxybiphenyl, 4,4'-diamino-2,2'-dicarboxybiphenyl, [bis(4-amino-2-carboxy)phenyl]methane, [bis(4-amino-3-carboxy)phenyl]methane, [bis(3-amino-4-carboxy)phenyl]methane, [bis(3-amino-5-carboxy)phenyl]methane, 2,2-bis[3-amino-4-carboxyphenyl]propane, 2,2-bis[4-amino-3-carboxyphenyl]propane, 2,2-bis[3-amino-4-carboxyphenyl]hexafluoropropane, 2,2-bis[4-amino-3-carboxyphenyl]hexafluoropropane, 3,3'-diamino-4,4'-dicarboxydiphenylether, 4,4'-diamino-3,3'-dicarboxydiphenylether, 4,4'-diamino-2,2'-dicarboxydiphenylether, 3,3'-diamino-4,4'-dicarboxydiphenylsulfone, 4,4'-diamino-3,3'-dicarboxydiphenylsulfone, 4,4'-diamino-2,2'-dicarboxydiphenylsulfone, 2,3-diaminophenol, 2,4-diaminophenol, 2,5-diaminophenol, 3,5-diaminophenol, 3,3'-diamino-4,4'-dihydroxybiphenyl, 4,4'-diamino-3,3'-dihydroxybiphenyl, 4,4'-diamino-2,2'-dihydroxybiphenyl, 4,4'-diamino-2,2',5,5'-tetrahydroxybiphenyl, 3,3'-diamino-4,4'-dihydroxydiphenylmethane, 4,4'-diamino-3,3'-dihydroxydiphenylmethane, 4,4'-diamino-2,2'-dihydroxydiphenylmethane, 2,2-bis[3-amino-4-hydroxyphenyl]propane, 2,2-bis[4-amino-3-hydroxyphenyl]propane, 2,2-bis[3-amino-4-hydroxyphenyl]hexafluoropropane, 2,2-bis[3-amino-4-hydroxyphenyl]hexafluoropropane, 3,3'-diamino-4,4'-dihydroxydiphenylether, 4,4'-diamino-3,3'-dihydroxydiphenylether, 4,4'-diamino-2,2'-dihydroxydiphenylether, 3,3'-diamino-4,4'-dihydroxydiphenylsulfone, 4,4'-diamino-3,3'-dihydroxydiphenylsulfone, 4,4'-diamino-2,2'-dihydroxydiphenylsulfone, 3,3'-diamino-4,4'-dihydroxydiphenylsulfide, 4,4'-diamino-3,3'-dihydroxydiphenylsulfide, 4,4'-diamino-2,2'-dihydroxydiphenylsulfide, 3,3'-diamino-4,4'-dihydroxydiphenylsulfoxide, 4,4'-diamino-3,3'-dihydroxydiphenylsulfoxide, 4,4'-diamino-2,2'-dihydroxydiphenylsulfoxide, 2,2-bis[4-(4-amino-3-hyrdoxyphenoxy)phenyl]propane, 4,4'-bis(4-amino-3-hyrdoxyphenoxy)biphenyl, 2,2-bis[4-(4-amino-3-hyrdoxyphenoxy)phenyl]sulfone, 4,4'-diamino-3,3'-dihydroxydiphenylmethane, 4,4'-diamino-2,2'-dihydroxydiphenylmethane, 2,2-bis[3-amino-4-carboxyphenyl]propane, and 4,4'-bis(4-amino-3-hydroxyphenoxy)biphenyl)biphenyl.

Concomitant use with the aforementioned diamines of such a diamino compound having either a carboxyl or hydroxyl group as a side chain makes it possible to cross-link polyimide fibers by using a reactive resin (reactive curing agent) such as epoxy resin or a cyanate compound as a cross-liking agent, thus enabling an improvement in the heat resistance of the resultant polyimide fibers.

Furthermore, because the diamino compound having either a carboxyl or hydroxyl group as a side chain has an active site of reaction with epoxy resin or the like, the fibers can bind with each other. This results in greater entanglement of fibers, and fibers having a lower bulk density are obtained.

In the present embodiment, supposing that the total amount of the diamines and the diamino compound that are used is 100 mol, it is preferable that the diamino compound having either a carboxyl or hydroxyl group as a side chain be used in an amount of not greater than 40 mol, or especially preferably not greater than 10 mol. If the diamino compound having either a carboxyl or hydroxyl group as a side chain is used in an excessive amount, the resulting polyimide fibers may become hard and brittle.

Examples of a method for reacting polyimide fibers with a reactive resin such as epoxy resin or a cyanate compound includes a method for obtaining cross-linked polyimide fibers by immersing the resultant polyimide fibers in a reactive resin solution and then drying the resultant polyimide fibers by heating and a method for spinning while spraying a reactive resin solution.

The polymeric resin contained in the polymeric resin solution in the present embodiment is polyamic acid and/or polyimide. When the polymeric resin is polyamic acid, the polymeric resin solution (polyamic acid solution) can be produced by polymerizing the diamine and the acid dianhydride so that the molar ratio of the acid dianhydride to the diamine in the organic solvent falls within a range of 0.9 to 1.1. It is more preferable that the molar ratio of the acid dianhydride to the diamine fall within a range of 0.95 to 1.05.

A reaction at such a ratio of reaction prevents a decrease in molecular weight from happening during imidization from polyamic acid to polyimide, thus making it possible to produce polyimide that is excellent in heat resistance and chemical resistance.

Meanwhile, when the polymeric resin is polyimide, the polymeric resin solution can be produced by imidizing the polyamic acid according to either such a chemical or thermal imidization method as will be described below.

Further, from the point of view of increasing the molecular weight of the resulting polymeric resin, it is preferable that a highly-pure acid dianhydride be used in the production of the polymeric resin solution. Specifically, it is preferable that the highly-pure acid dianhydride be an acid dianhydride containing not less than 98% by mass of an acid dianhydride having a closed ring structure.

Further, similarly, it is preferable that the diamines and the diamino compound contain not less than 98% be mass of a compound having a diamino structure.

It is preferable that the solid content concentration of the polymeric resin solution that is used in the present embodiment fall within a range of 0.1% by mass to 50% by mass, or more preferably 1% by mass to 40% by mass. From the point of view of controlling the thixotropic properties of the polymeric resin solution, i.e., from the point of view of controlling the thixotropic index within a preferred range in a spinning step, it is even more preferable that the solid content concentration fall within a range of 10% by mass to 35% by mass, or especially preferably 10% by mass to 30% by mass.

The solid content concentration can be calculated according the following formula:

$$\text{Solid Content Concentration (\% by mass)} = \text{Mass of Solute}/(\text{Mass of Solvent} + \text{Mass of Solute}) \times 100.$$

The polymeric resin solution can be obtained by stirring and polymerizing the diamines and an acid anhydride within a range of −20 to 60° C., or more preferably not higher than 50° C., in an atmosphere of inert gas. It should be noted that the polymeric resin solution can be mixed, as needed, with a filler, a lubricant, a curing catalyst, a dehydrating agent, a coloring agent, and/or the like.

The present embodiment spins with use of the polymeric resin solution and then heats it to completely remove the solvent and, when the polymeric resin is polyamic acid, can produce polyimide fibers through imidization.

In particular, a non-thermoplastic polyimide resin that is high in heat resistance is generally low in solubility to an organic solvent, and it is difficult to spin such a polyimide resin as a polyimide resin solution. Meanwhile, in the present embodiment, use of a polyamic acid solution as the polymeric resin solution makes it possible to spin the non-thermoplastic polyimide resin, which has conventionally been hard to spin. The non-thermoplastic polyimide resin is preferred because it improves heat resistance.

It is preferable that a polyimide fiber assembly according to the present embodiment contain the non-thermoplastic polyimide fibers composed of a non-thermoplastic polyimide resin, because such inclusion of the non-thermoplastic polyimide fibers, which are high in heat resistance, makes it possible to improve the heat resistance of the polyimide fiber assembly, and leads to better shape-retaining properties and a lower bulk specific gravity when a fiber assembly composed of polyamic acid is imidized at a high temperature.

The term "non-thermoplastic polyimide fibers" here means polyimide fibers that do not have a peak of the tan δ value at not higher than 300° C. when the dynamic viscoelastic behavior of the polyimide fibers is measured. More specifically, the term "non-thermoplastic polyimide fibers" in the present embodiment means polyimide fibers that satisfy either of the following conditions: the temperature at which the storage modulus of elasticity drops is not lower than 310° C. as measured by such a method as will be described below; and the temperature at which the tan δ value reaches its peak is higher than 300° C. The temperature at which the tan δ value reaches its peak and the temperature at which the storage modulus of elasticity drops are explained below. The present embodiment measures the temperature at which the tan δ value reaches its peak and the temperature at which the storage modulus of elasticity drops, and judges, in accordance with the temperature at which the storage modulus of elasticity drops, whether the polyimide fibers are "non-thermoplastic polyimide fibers".

The temperature at which the tan δ value reaches its peak and the temperature at which the storage modulus of elasticity drops mean the temperature at which the storage modulus of elasticity E' drops and the temperature at which the tan δ value reaches its peak as obtained by measuring the dynamic viscoelastic behavior of a 25-μm-thick polyimide film produced from a polyamic acid solution that serves as raw material for polyimide fibers.

Specifically, a method for producing such a polyimide film is as follows: A polyimide film is produced on a glass substrate by applying a polyamic acid solution onto the glass substrate so that the final polyimide film has a thickness of 25 μm, putting the glass substrate into an oven cooled down to room temperature, heating the oven to 400° C. at a heating rate of 6° C./min, and then cooling down the glass substrate slowly to room temperature.

The dynamic viscoelastic behavior can be measured in a tensile mode under the following conditions after cutting a 9 mm×40 mm sample out of the polyimide film and setting the sample on a DMS200 manufactured by SEIKO Electronics Industrial Co., Ltd. It should be noted that it is preferable that when the polyimide film is brittle and therefore hard to measure, the maximum calcination temperature be reduced accordingly.

<Conditions for Measurement>

Profile temperature: 20° C. to 400° C. (at a heating rate of 3° C./min); however, it is preferable that the temperature be reduced accordingly lest the polyimide film melts.

Frequency: 5 Hz

Lamp. (targeted value of alternating-current strain amplitude): 20 μm

Fbase (minimum value of tension during measurement): 0 g

F0gain (factor that changes tension during measurement according to alternating-current strain amplitude): 3.0

As a result of measurement under these conditions, the storage modulus of elasticity E' and loss modulus of elasticity E" at the aforementioned profile temperature are obtained.

Figure 8:
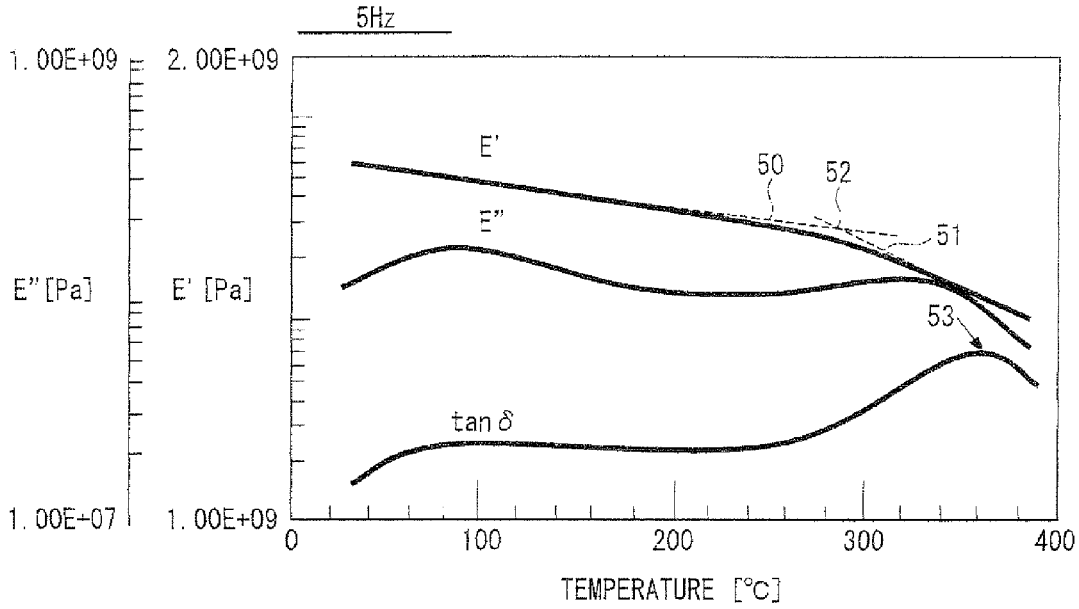
FIG. 8 shows an example of a result of measurement of dynamic viscoelastic behavior.

The term "temperature at which the storage modulus of elasticity E' drops" here means a temperature at which the storage modulus of elasticity starts to drop sharply. With reference to FIG. 8, which shows an example of measurement of dynamic viscoelastic behavior, a curve of the storage modulus of elasticity in the profile temperature range has a tangent 50 drawn to a straight line preceding the start of a change in storage modulus of elasticity and a tangent 51 drawn to a straight line following the end of the change in storage modulus of elasticity, and the temperature at a point of intersection 52 between the tangents is measured. It is this temperature that serves as the temperature at which the storage modulus of elasticity drops. It should be noted that when the temperature at which the storage modulus of elasticity drops does not exist within a range of not higher than 400° C., the present embodiment assumes that the temperature at which the storage modulus of elasticity drops is 400° C.

The curve indicated by "tan δ" in FIG. 8 represents the tan δ value, which is a value calculated using the storage modulus of elasticity E' and the loss modulus of elasticity E" according to the following formula:

$$\tan \delta = E'' \div E'.$$

It should be noted that there is another example of the method for judging whether polyimide fibers are "non-thermoplastic polyimide fibers". Specifically, those polyimide fibers which both do not melt and retain their shapes even when left for ten minutes in an oven heated to 400° C. can be judged as "non-thermoplastic polyimide fibers" in the present embodiment.

That is, those polyimide fibers which satisfy any of the following conditions are judged as "non-thermoplastic polyimide fibers": (i) Do not have a peak of the tan δ value at not higher than 300° C.; (ii) Have a storage modulus of elasticity that drops at a temperature of not lower than 310° C.; and (iii) Both do not melt and retain their shapes even when left for ten minutes in an oven heated to 400° C.

It is preferable that a non-thermoplastic polyimide resin that can be suitably used in the present embodiment be a polyimide resin having any of the following structures. It is preferable that when used in the polymeric resin solution, a polyimide resin having any of the following structures or a precursor thereof, i.e., a polyamic acid resin be used as the polymeric resin.

Examples are:

(1) Polyimide resin composed of pyromellitic acid dianhydride and 4,4'-diaminodiphenylether;

(2) Polyimide resin composed of pyromellitic acid dianhydride, 4,4'-diaminodiphenylether, and p-phenylenediamine;

(3) Polyimide resin composed of pyromellitic acid dianhydride, 3,3',4,4'-biphenyl tetracarboxylic acid dianhydride, 4,4'-diaminodiphenylether, and p-phenylenediamine;

(4) Polyimide resin composed of 3,3',4,4'-biphenyl tetracarboxylic acid dianhydride and p-phenylenediamine; and (5) Polyimide resin composed of 3,3',4,4'-benzophenone tetracarboxylic acid dianhydride and p-phenylenediamine; Use of such a non-thermoplastic polyimide resin makes it possible to obtain highly heat-resistant polyimide fibers.

Alternatively, in the present embodiment, it is also possible to directly spin, as the polymeric resin solution, a polyimide resin solution obtained by dissolving a polyimide resin in an organic solvent. Examples of methods for producing such a polyimide resin solution include a method for producing a polyimide resin solution through polyamic acid and a method for producing a polyimide resin solution through an isocyanate compound. These methods are described below.

<Method for Producing a Polyimide Resin Through Polyamic Acid>

Examples of the method for producing a polyimide resin through polyamic acid include: a chemical imidization method by which the polyamic acid contained in a polyamic acid solution produced by polymerizing the acid dianhydride and the diamines in the organic solvent solution, i.e., by the method for producing a polyamic acid solution is reacted with a dehydrating agent to be imidized; and a thermal imidization method by which the polyamic acid is dehydrated by heat.

In the case of the chemical imidization reaction, a polyimide solution can be obtained by adding a tertiary amine (serving as an imidizing catalyst, suitably usable examples of which include pyridine, trimethylamine, picoline, and quinoline) and a dehydrating agent (suitably usable examples of which include acetic anhydride) to the polyamic acid solution and then heating the polyamic acid solution to reflux.

It is preferable here that the heating temperature be appropriately selected from temperatures of not higher than 200° C. Further, from the point of view of increasing the rate of reaction and increasing the rate of imidization, it is more preferable that the heating temperature fall within a range of not lower than 50° C. to not higher than 200° C., or especially preferably not lower than 80° C. to not higher than 160° C. The heating temperature within the range is preferred because a high-molecular weight polyimide solution is obtained without greatly decreasing the molecular weight of the polyamic acid solution during the imidization.

According to the chemical imidization method, a polyimide resin can be obtained by extracting the resultant polyimide solution with a poor solvent of polyimide. Specifically, the polyimide resin can be separated as a solid by either dispersing the polyimide solution in the poor solvent or adding the poor solvent to the polyimide solution. The polyimide solution can be produced by dissolving the resulting polyimide resin again in an organic solvent.

It should be noted that suitably usable examples of the poor solvent include solvents such as water, methanol, ethanol, propanol, and butanol.

In the case of the thermal imidization method, the polyamic acid solution can be imidized by (i) a vacuum heat imidization method of taking out polyimide directly from the polyamic acid solution by vacuum-heating the polyamic acid solution in a vacuum vessel heated to a temperature not lower than the glass-transition temperature of the polyimide, (ii) a method of imidizing the polyamic acid solution by directly heating it to reflux, or (iii) a method of heating and dehydrating the polyamic acid solution with concomitant use of toluene or hexane that forms an azeotrope with water which is generated. It is preferable here that the heating temperature be not lower than 100° C., or especially preferably not lower than 150° C., because at such a heating temperature the polyamic acid solution can be imidized efficiently.

In order for the polyimide to be able to be spun as soluble in an organic solvent, it is only necessary to appropriately select raw materials for use from among the acid dianhydrides and the diamines. Suitably usable examples of the acid dianhydrides include 2,2-bis[4-(3,4-dicarboxyphenoxy)phenyl]propane dianhydride, 2,2-bis[4-(3,4-dicarboxyphenoxy)phenyl]hexafluoropropane dianhydride, 2,2-bis(4-hydroxyphenyl)propanedibenzoate-3,3',4,4 tetracarb oxylic acid dianhydride, 3,3',4,4'-biphenyl tetracarboxylic acid dianhydride, 2,3,3',4-biphenyl tetracarboxylic acid dianhydride, 2,2'-hexafluoropropylidenediphthalic acid dianhydride, 3,3',4,4'-benzophenone tetracarboxylic acid dianhydride, 4,4'-oxydiphthalic acid dianhydride, 3,3',4,4'-diphenylsulfontetracarboxylic acid dianhydride, pyromellitic acid dianhydride, 1,2,5,6-naphthalene tetracarboxylic acid dianhydride, 2,3,6,7-naphthalene tetracarboxylic acid dianhydride, cyclobutane tetracarboxylic acid dianhydride, methylcyclobutane tetracarboxylic acid dianhydride, and 1,2,3,4-tetracarboxybutane dianhydride. It should be noted that these compounds may be used alone or in combination of two or more of them. Further, as a diamine, any of the diamines may be used.

<Method for Producing a Polyimide Resin with Use of an Isocyanate Compound>

According to the method for producing a polyimide resin with use of an isocyanate compound, a polyimide solution can be obtained through a single-stage imidization reaction by mixing an acid dianhydride and an isocyanate compound into an organic solvent so that the molar ration of the isocyanate compound to the acid dianhydride falls within a range of 0.90 to 1.10 and heating the mixture to reflux.

It is preferable here that the reaction temperature fall within a range of 50° C. to 250° C., more preferably 60° C. to 200° C., or especially preferably 70° C. to 180° C.

The reaction time can be appropriately selected according to batch size, reaction conditions that are adopted, and the like. It is preferable that the reaction temperature and the reaction time be controlled during the reaction as needed by causing the reaction in the presence of a catalyst such as tertiary amines and metal or semimetal compounds such as alkali metals, alkali earth metals, tin, zinc, titanium, and cobalt.

Examples of the acid dianhydride that is used in the reaction include 2,2-bis[4-(3,4-dicarboxyphenoxy)phenyl]propane dianhydride, 2,2-bis[4-(3,4-dicarboxyphenoxy)phenyl]hexafluoropropane dianhydride, 2,2-bis(4-hydroxyphenyl)propanedibenzoate-3,3',4,4'-tetracarb oxylic acid dianhydride, 3,3',4,4'-biphenyl tetracarboxylic acid dianhydride, 2,3,3',4-biphenyl tetracarboxylic acid dianhydride, 2,2'-hexafluoropropylidenediphthalic acid dianhydride, 3,3',4,4'-benzophenone tetracarboxylic acid dianhydride, 4,4'-oxydiphthalic acid dianhydride, 3,3',4,4'-diphenylsulfontetracarboxylic acid dianhydride, pyromellitic acid dianhydride, 1,2,5,6-naphthalene tetracarboxylic acid dianhydride, 2,3,6,7-naphthalene tetracarboxylic acid dianhydride, cyclobutane tetracarboxylic acid dianhydride, methylcyclobutane tetracarboxylic acid dianhydride, and 1,2,3,4-tetracarboxybutane dianhydride. It should be noted that these compounds may be used alone or in combination of two or more of them.

Examples of the isocyanate compound that is used in the reaction include: diphenylmethane-2,4'-diisocyanate; 3,2'-, 3,3'-, 4,2'-, 4,3'-, 5,2'-, 5,3'-, 6,2'-, or 6,3'-dimethyldiphenylmethane-2,4'-diisocyanate; 3,2'-, 3,3'-, 4,2'-, 4,3'-, 5,2'-, 5,3'-, 6,2'-, or 6,3'-diethyldiphenylmethane-2,4'-diisocyanate; 3,2'-, 3,3'-, 4,2'-, 4,3'-, 5,2'-, 5,3'-, 6,2'-, or 6,3'-dimethoxydiphenylmethane-2,4'-diisocyanate; diphenylmethane-4,4'-diisocyanate, diphenylmethane-3,3'-diisocyanate; diphenylmethane-3,4'-diisocyanate; diphenylether-4,4'-diisocyanate; benzophenone-4,4'-diisocyanate; diphenylsulfone-4,4'-diisocyanate; trilene-2,4-diisocyanate; trilene-2,6-diisocyanate; m-xylylenediisocyanate; p-xylylenediisocyanate; naphthalene-2,6-diisocyanate; and 4,4'-[2,2-bis(4-phenoxyphenyl)propane]diisocyanate. Especially preferred examples include diphenylmethane-4,4'-diisocyanate, trilene-2,6-diisocyanate, and trilene-2,4-diisocyanate. It should be noted that these compounds may be used alone or in combination of two or more of them.

It is preferable that the solid content concentration of the polyimide solution that is used in the present embodiment fall within a range of 5% by mass to 40% by mass, or more preferably 10% by mass to 30% by mass.

(V) Polyimide Fiber Assembly

A polyimide fiber assembly according to the present embodiment includes polyimide fibers having curved shapes with an average fiber diameter falling within a range of greater than 1 μm to not greater than 100 μm, the polyimide fiber assembly having a bulk density falling within a range of not less than 1 kg/m$^3$ to not greater than 30 kg/m$^3$. In particular, it is preferable that the polyimide fiber assembly include at least such non-thermoplastic polyimide fibers as described above.

The polyimide fiber assembly is obtained by producing the polyimide fibers by such a production method as described above, and the polyimide fibers may bind with each other or exist independently without binding with each other.

Further, the polyimide fibers may bind through a binder resin such as a polyimide resin, a polyamic resin, a urea resin, a phenol resin, a urethane resin, a melamine resin, a polyether resin, or a polyether ketone ketone resin.

The method by which the polyimide fibers bind with each other may be a publicly-known method such as spraying a binder-resin-containing solution onto the polyimide fibers produced or drying the polyimide fibers by heat after dipping the polyimide fibers in the binder-resin-containing solution.

Alternatively, it is possible, during spinning, to bind the polymeric resin 3' in the state of a fiber assembly by passing the polymeric resin 3' after the forming step through an atmosphere into which the binder-resin-containing solution has been sprayed. This method is efficient and preferable because the finer assembly and the binder resin can be dried by heat at the same time.

It is thus preferable that the polyimide fibers bind with each other, because such binding is likely to lead to a low bulk density, i.e., a feature of the present invention and, moreover, because the binding of the fibers with each other leads to improvements in elasticity and cohesiveness of the fibers.

It should be noted that in the "Forming Step (II)" of the present embodiment, the polymeric resin 3' can also be obtained by discharging two or more types of polymeric resin solution through different spinnerets at the same time and causing them to fly. In particular, the binder resin can be replaced by causing a thermally-adhesive polymeric resin solution to fly in addition to the polymeric resin solution, which serves as raw material for the non-thermoplastic fibers.

The term "thermally-adhesive polymeric resin" here means a polymeric resin that is fused with the non-thermoplastic polyimide fibers during the heating for solvent removal or the imidization of the polyamic acid after the spinning of the polyamic acid solution or polyimide solution, which serves as raw material for the non-thermoplastic polyimide fibers, and is not completely thermally melted during imidization into a non-thermoplastic polyimide resin.

It is preferable that such a thermally-adhesive polymeric resin be concomitantly used, because concomitant use of such a thermally-adhesive polymeric resin makes it possible to control the bulk density so that it is low and to increase the force of binding of the polyimide fibers with each other.

It is preferable that such a thermally-adhesive polymeric resin be polyamic acid or polyimide having any of the following structures:

(1) A polyamic acid or polyimide resin composed of pyromellitic acid dianhydride, 4,4'-diaminodiphenylether, and 2,2-bis[4-(4-aminophenoxy)phenyl]propane, wherein assuming that the total amount of diamine is 100 mol, the amount of 2,2-bis[4-(4-aminophenoxy)phenyl]propane is not less than 50 mol;

(2) A polyamic acid or polyimide resin composed of pyromellitic acid dianhydride, 4,4'-diaminodiphenylether, and 1,3-bis(3-aminophenoxy)benzene, wherein assuming that the total amount of diamine is 100 mol, the amount of 1,3-bis(3-aminophenoxy)benzene is not less than 50 mol;

(3) A polyamic acid or polyimide resin composed of pyromellitic acid dianhydride, 4,4'-diaminodiphenylether, and bis[4-(3-aminophenoxy)phenyl]sulfone, wherein assuming that the total amount of diamine is 100 mol, the amount of bis[4-(3-aminophenoxy)phenyl]sulfone is not less than 50 mol;

(4) A polyamic acid or polyimide resin composed of 3,3',4,4'-biphenyl tetracarboxylic acid dianhydride and 4,4'-diaminodiphenylether;

(5) A polyamic acid or polyimide resin composed of 3,3',4,4'-benzophenone tetracarboxylic acid dianhydride and 4,4'-diaminodiphenylether;

(6) A polyamic acid or polyimide resin composed of 2,2-bis[4-(3,4-dicarboxyphenoxy)phenyl]propane dianhydride and 4,4'-diaminodiphenylether and/or m-phenylenediamine;

(7) A polyamic acid or polyimide resin composed of 2,3,3',4-biphenyl tetracarboxylic acid dianhydride and p-phenylenediamine;

(8) A polyamic acid or polyimide resin composed of 2,3,3',4-biphenyl tetracarboxylic acid dianhydride and 4,4'-diaminodiphenylether;

(9) A polyamic acid or polyimide resin composed of 2,2-bis[4-(3,4-dicarboxyphenoxy)phenyl] propane dianhydride and 4,4'-diaminodiphenylsulfone,

(10) A polyamic acid or polyimide resin composed of 2,2-bis[4-(3,4-dicarboxyphenoxy)phenyl]propane dianhydride and 3,3'-diaminodiphenylsulfone; and

(11) A polyamic acid or polyimide resin composed of 3,3',4,4'-biphenyl tetracarboxylic acid dianhydride and 1,3-bis(4-aminophenoxy)benzene.

The thermally-adhesive polymeric resin is preferable in terms of shape retention because it is so high in heat resistance as to remain as fibers without melting even in the heating step; furthermore, the thermally-adhesive polymeric resin is preferable because the fibers binds with each other through it.

The term "curved shapes" in this specification means that the fibers are curved in the middle or, more specifically, that the fibers are arched, bent into circles, or spiraled into loops, for example. Further, it is not necessary that all of the polyimide fibers constituting the polyimide fiber assembly have curved shapes, and linear polyimide fibers may be included. Furthermore, each of the "polyimide fibers having curved shapes" may be either wholly or only partially curved.

It should be noted that the polyimide fibers constituting the polyimide fiber assembly according to the present embodiment have curved shapes that are obtained by a drying step in a spinning process, unlike crimped fibers that are produced with use of a general apparatus for crimping spinning fibers.

When the polyimide fibers are non-thermoplastic polyimide fibers, fibers obtained by normal dry spinning or wet spinning and crimped by a crimping apparatus are hard to thermally set and therefore are easily uncurled by heat. For this reason, even in production through a general step of producing a nonwoven fabric, an increase in bulk density has been inevitable during high-temperature heating.

Meanwhile, since the polyimide fibers according to the present embodiment are curved in the step of producing the polyimide fibers, they are hard to disentangle and therefore unlikely to change in bulk density even when exposed to high temperatures.

Further, it is preferable that the "curved shapes" have a curvature radius of not less than 1 μm to not greater than 1 m. Such inclusion of curved polyimide fibers and such a curvature radius of the curved polyimide fibers make it possible to obtain a polyimide fiber assembly with improved elastic recovery and a low bulk density.

The polyimide fibers constituting the polyimide fiber assembly according to the present embodiment are not identical in fiber length but have a predetermined distribution of fiber lengths. It is preferable that the fiber length be not less than 1 cm, and it is preferable that a long fiber exceeding 1 m be included. It should be noted that the distribution of fiber lengths varies according to the state of stability during spinning.

The polyimide fiber assembly is high in porosity and excellent in sound absorbency and heat-retaining property and therefore can be used as a sound-absorbing and thermal insulating material. In particular, the polyimide fiber assembly can be used a thermal insulating and sound-absorbing material for use in aircraft or a thermal insulating material serving as a building component.

The production method according to the present embodiment makes it possible to obtain the polyimide fiber assembly whose bulk density preferably falls within a range of 1 $kg/m^3$ to 30 $kg/m^3$, more preferably 1 $kg/m^3$ to 20 $kg/m^3$, or even more preferably 1 $kg/m^3$ to 15 $kg/m^3$. Such control of the bulk density makes it possible for the polyimide fiber assembly to be suitably used as a thermal insulating and sound-absorbing material for use in aircraft. It should be noted that the bulk density in this specification means a value measured by a method described later in Examples.

Further, the polyimide fibers according to the present embodiment have an average fiber diameter of greater than 1 μm to not greater than 100 μm. It is preferable that the average fiber diameter falls within the range, because such an average fiber diameter results in lower specific thermal conductivity when the polyimide fibers are used in various thermal insulating materials, flame-retardant mats, and heat-resistant garments. Further, when the polyimide fibers are used in filter fabrics and heat-resistant bag filters, such filter fabrics and heat-resistant bag filters have toughness and great strength and therefore are hard to tear. Further, it is more preferable that the polyimide fibers according to the present embodiment have an average fiber diameter of greater than 1 μm to not greater than 50 μm, even more preferably greater than 1 μm to not greater than 30 μm, especially preferably greater than 1 μm to not greater than 20 μm, or most preferably greater than 1 μm to not greater than 10 μm. Such finer fibers can be suitably used as a thermal insulating and sound-absorbing material for use in aircraft with improved sound absorbency.

Examples of such a method for controlling the fiber diameter include controlling the fiber diameter by appropriately selecting the spinning rate of the polyimide fibers, i.e., the discharge rate of a raw material (the polyamic acid solution or polyimide resin solution). Further, the bulk density can be controlled by appropriately selecting the distance from the spinneret to a catching device.

It should be noted that the average fiber diameter in this specification means a value measured by a method described later in Examples.

A sound-absorbing material, a thermal insulating material, a flame-retardant mat, a filter fabric, a heat-resistant garment, a nonwoven fabric, a thermal insulating and sound-absorbing material for use in aircraft, and a heat-resistant bag filter according to the present embodiment that are obtained by using the polyimide fiber assembly can be produced by the same method as a method that involves the use of a conventional publicly-known polyimide fiber assembly.

When the polyimide fiber assembly is used as a thermal insulating and sound-absorbing material for use in aircraft, a bulk density of not less than 1 $kg/m^3$ to not greater than 10 $kg/m^3$ is effective in reducing the weight of an aircraft. In particular, it is preferable that the bulk density fall within a range of not less than 1 $kg/m^3$ to not greater than 6 $kg/m^3$.

Alternatively, when the polyimide fiber assembly is used as a filter fabric, it is preferable that the polyimide fiber assembly be used in the form of a nonwoven fabric. It is preferable that the unwoven fabric have a bulk density of not less than 10 $kg/m^3$ to not greater than 30 $kg/m^3$, because such a bulk density makes it possible to reduce a pressure loss of the filter fabric and control the catching efficiency at an optimum value. In particular, when the polyimide fiber assembly is used as a nonwoven fabric, it is preferable that the polyimide fiber assembly be knit into a surface of a ground fabric by a needle-punching method. Further, by sewing the unwoven fabric into the shape of a bag filter, a heat-resistant bag filter can be obtained.

As described above, a polyimide fiber assembly according to the present invention includes polyimide fibers having curved shapes with an average fiber diameter falling within a range of greater than 1 μm to not greater than 100 μm, the polyimide fiber assembly having a bulk density falling within a range of not less than 1 $kg/m^3$ to not greater than 30 $kg/m^3$.

This brings about an effect of making it possible to provide a polyimide fiber assembly that is both excellent in thermal insulation performance and sound absorbency and light in weight in addition to having such properties of the polyimide fibers as being excellent in flame retardance, heat resistance, and chemical resistance.

Further, as described above, a thermal insulating material according to the present invention is obtainable by using such a polyimide fiber assembly according to the present invention.

This makes it possible to provide a thermal insulating material that is both excellent in thermal insulation performance and light in weight in addition to having such properties of the polyimide fibers as being excellent in flame retardance, heat resistance, and chemical resistance.

Further, as described above, a flame-retardant mat according to the present invention is obtainable by using such a polyimide fiber assembly according to the present invention.

This makes it possible to provide a flame-retardant mat that is both excellent in thermal insulation performance and sound absorbency and light in weight in addition to having such properties of the polyimide fibers as being excellent in flame retardance, heat resistance, and chemical resistance.

Further, as described above, a filter fabric according to the present invention is obtainable by using such a polyimide fiber assembly according to the present invention.

This makes it possible to provide a filter fabric that is light in weight in addition to having such properties of the polyimide fibers as being excellent in flame retardance, heat resistance, and chemical resistance.

Further, as described above, a heat-resistant garment according to the present invention is obtainable by using such a polyimide fiber assembly according to the present invention.

This makes it possible to provide a heat-resistant garment that is both excellent in thermal insulation performance and light in weight in addition to having such properties of the polyimide fibers as being excellent in flame retardance, heat resistance, and chemical resistance.

Further, as described above, a nonwoven fabric according to the present invention is obtainable by using such a polyimide fiber assembly according to the present invention.

This makes it possible to provide a nonwoven fabric that is both excellent in thermal insulation performance and sound absorbency and light in weight in addition to having such properties of the polyimide fibers as being excellent in flame retardance, heat resistance, and chemical resistance.

Further, as described above, a thermal insulating and sound-absorbing material for use in aircraft according to the present invention is obtainable by using such a polyimide fiber assembly according to the present invention.

This makes it possible to provide a thermal insulating and sound-absorbing material for use in aircraft that is both excellent in thermal insulation performance and sound absorbency and light in weight in addition to having such properties of the polyimide fibers as being excellent in flame retardance, heat resistance, and chemical resistance.

Further, as described above, a heat-resistant bag filter according to the present invention is obtainable by using such a polyimide fiber assembly according to the present invention.

This makes it possible to provide a heat-resistant bag filter that is light in weight in addition to having such properties of the polyimide fibers as being excellent in flame retardance, heat resistance, and chemical resistance.

EXAMPLES

The present invention is described in more detail below with reference to Examples; however, the present invention is not limited to Examples below.

<Average Fiber Diameter>

The average fiber diameter is an average diameter of thirty fibers as measured with an electron microscope (JSM-6380LA; manufactured by JEOL Datum Ltd.). As for modified cross-section fibers, the maximum length was calculated as the diameter.

<Viscosity>

The viscosity of the polymeric resin solution was measured by using a type B viscometer at 23° C. with a rotor No. 7 at 2 rpm.

<Thixotropic Index>

The thixotropic index was calculated according to the following formula:

$$\text{Thixotropic Index}=(\text{Viscosity at 2 rpm})/(\text{Viscosity at 10 rpm}),$$

after measuring the viscosity by using a type B viscometer at 23° C. with a rotor No. 7 at 2 rpm and 10 rpm.

When the viscosity exceeds 4,000 P, 10 rpm exceeds the measuring limit. Therefore, the value measured at 10 rpm is replaced by a value measured at 5 rpm.

<Solid Content Concentration>

The solid content concentration was calculated according to the following formula:

$$\text{Solid Content Concentration (\% by mass)}=\text{Mass of Solute}/(\text{Mass of Solvent}+\text{Mass of Solute})\times 100.$$

It should be noted that the mass of the solute is the total mass of polymeric resin raw materials (an acid dianhydride and a diamine, in the case of a polyamic acid) used in the reaction and raw materials, other than the solvent, remaining in the resin.

Further, the mass of the solvent is the total mass of the solvent, in which the polymeric resin raw materials and the raw materials, other than the solvent, remaining in the resin are dissolved or dispersed.

<Concentration of the Solvent with Respect to the Solid Content of the Polymeric Resin>

The concentration (% by mass) of the solvent with respect to the solid content was calculated according to the following formula:

$$\text{Concentration of Solvent with Respect to Solid Content (\% by mass)}=(A-B)/B\times 100,$$

where A is the mass of a 10 cm×10 cm×2 cm sample cut out of the fibrous polymeric resin as caught before drying by heating and B is the mass of the polymeric resin from which the solvent has been completely volatilized at and for heating, drying, and calcination temperatures and times in Examples.

<Bulk Density>

The mass A (g) of a 2.5 cm×10 cm×10 cm sample cut out of the spun polyimide fiber assembly left at rest for one hour at normal temperature and normal pressures was measured. From this result, the bulk density of the polyimide fiber assembly was calculated according to the following formula:

$$\text{Bulk Density (kg/m}^3)=\text{A(g)}/(250\ \text{cm}^3)\times(10^6\ \text{cm}^3/1\ \text{cm}^3)\div(1{,}000\ \text{g}/1\ \text{kg}).$$

<Normal Incident Sound Absorption Coefficient>

The sound absorbency of a polyimide fiber assembly is evaluated by a value measured by the following method for measuring a normal incident sound absorption coefficient. A larger sound absorption coefficient means better sound absorption performance.

The normal incident sound absorption coefficient was measured according to ASTM-E-1050 normal incident sound absorption coefficient testing under the following conditions: a sample diameter of 29 mm, a thickness of 2.54 cm (1 inch), a back air layer of 0 mm, a measuring frequency band of 500 to 6,300 Hz (⅓ octave band).

<Comparative Materials>

For comparison of heat insulation performance and sound absorbency with fibers obtained in Examples, glass wool manufactured by Johns Manville (marketed as Microlite® AA Premium NR; having a bulk density of 5.5 kg/m$^3$) was used as a comparative material.

Example of Synthesis 1

A reaction was induced in a reaction apparatus prepared by attaching, into a two-liter glass separable flask whose internal gas had been replaced by nitrogen, a stirring blade for stirring a solution. First, a solution obtained by dissolving 91.8 g (0.458 mol) of 4,4-diaminodiphenylether (hereinafter abbreviated as "4,4'-ODA") in 779 g of N,N-dimethylformamide (hereinafter abbreviated as "DMF") was kept warm at 40° C. Into this solution, 95.0 g (0.436 mol) of pyromellitic acid dianhydride (hereinafter abbreviated as "PMDA") was poured, which was then completely dissolved. To this solution, a solution obtained by dissolving 5.0 g of PMDA in 66.5 g of DMF was added in small portions. The addition was stopped at the point of time where the viscosity of the solution became 100 P at 23° C. Thus obtained was a polymeric resin solution (A-1) for use in spinning.

It should be noted that the solution has a thixotropic index of 1.01 and a solid content concentration of 18.5% by mass.

A polyimide film was produced from this polymeric resin solution (A-1), and the temperature at which the storage modulus of elasticity drops was measured and found to be 360° C. Therefore, polyimide fibers that are obtained from the polyamic acid solution are "non-thermoplastic polyimide fibers".

Example of Synthesis 2

A reaction was induced in a reaction apparatus prepared by attaching, into a two-liter glass separable flask whose internal gas had been replaced by nitrogen, a stirring blade for stirring a solution. First, a solution obtained by dissolving 91.8 g (0.458 mol) of 4,4'-ODA in 779 g of DMF was kept warm at 40° C. Into this solution, 95.0 g (0.436 mol) of PMDA was poured, which was then completely dissolved. To this solution, a solution obtained, by dissolving 5.0 g of PMDA in 66.5 g of DMF was added in small portions. The addition was stopped at the point of time where the viscosity of the solution became 1,500 P at 23° C. Thus obtained was a polymeric resin solution (A-2) for use in spinning.

It should be noted that the solution has a thixotropic index of 1.03 and a solid content concentration of 18.5% by mass.

A polyimide film was produced from this polymeric resin solution (A-2), and the temperature at which the storage modulus of elasticity drops was measured and found to be 360° C. Therefore, polyimide fibers that are obtained from the polyamic acid solution are "non-thermoplastic polyimide fibers".

Example of Synthesis 3

A reaction was induced in a reaction apparatus prepared by attaching, into a two-liter glass separable flask whose internal gas had been replaced by nitrogen, a stirring blade for stirring a solution. First, a solution obtained by dissolving 36.7 g (0.183 mol) of 4,4'-ODA and 29.8 g (0.275 mol) of p-phenylenediamine in 667 g of DMF was kept warm at 40° C. Into this solution, 95.0 g (0.436 mol) of PMDA was poured, which was then completely dissolved. To this solution, a solution obtained by dissolving 5.0 g of PMDA in 66.5 g of DMF was added in small portions. The addition was stopped at the point of time where the viscosity of the solution became 4,000 P at 23° C. Thus obtained was a polymeric resin solution (A-3) for use in spinning.

It should be noted that the solution has a thixotropic index of 1.15 and a solid content concentration of 18.5% by mass.

A polyimide film was produced from this polymeric resin solution (A-3), and the temperature at which the storage modulus of elasticity drops was measured and found to be 380° C. Therefore, polyimide fibers that are obtained from the polyamic acid solution are "non-thermoplastic polyimide fibers".

Example 1

The polymeric resin solution (A-1) obtained in Example of Synthesis 1 was spun with use of the apparatus of FIG. 1 under the following conditions:

Orifice: 0.7 mm in diameter; circle in shape; one-hole

Discharge rate of the polymeric resin solution: 0.2 g/min/hole

Distance between the orifice and the airflow generating device: 20 cm

Type of gas to be blown: air

Angle of intersection of the airflow: 95 degrees

Temperature of the airflow: 25° C.

Velocity of wind from the airflow generating device: 9 m/sec

Flying distance of the polymeric resin solution: 2 m

The resulting polymeric resin was caught in a catching net for five hours. Thus obtained was a fibrous polymeric resin composed of polyamic acid. The concentration of the solvent with respect to the solid content of the polymeric resin was 80% by mass.

Figure 4:
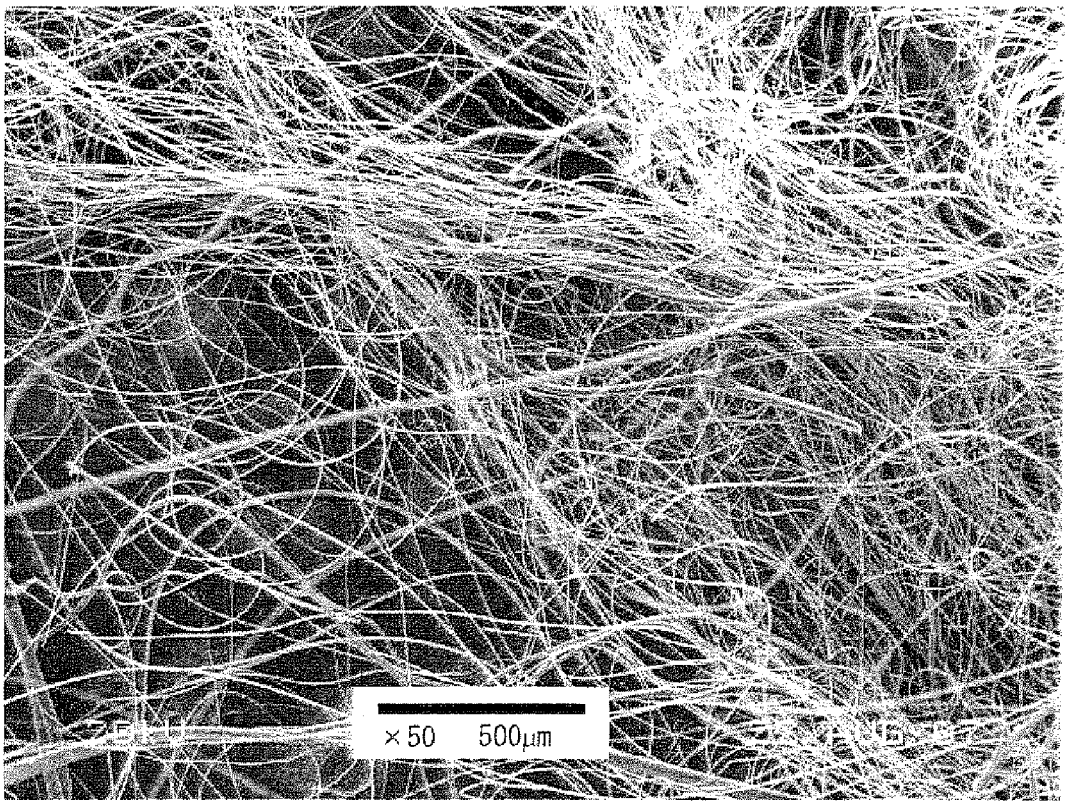
FIG. 4

The fibrous substances were collected and put into an oven heated to 100° C., and the oven was heated to 420° C. over one hour. The fibrous substances were calcined for five minutes at 420° C. to give polyimide fibers. FIG. 4 shows an electron micrograph of the polyimide fibers. The resultant fibrous substances were composed of tangled but independent fibers, some of which were curved. The resultant fibrous substances had an average diameter of 4.0 μm, and an assembly of these fibers had a bulk density of 7.0 kg/m$^3$.

Further, the fiber assembly was nearly equal in thermal insulating performance and sound absorbency (see Table 1) to the comparative material.

Example 2

The same operation was performed as in Example 1, except that the polymeric resin solution (A-1) was replaced by the polymeric resin solution (A-2) obtained in Example of Synthesis 2.

Figure 5:
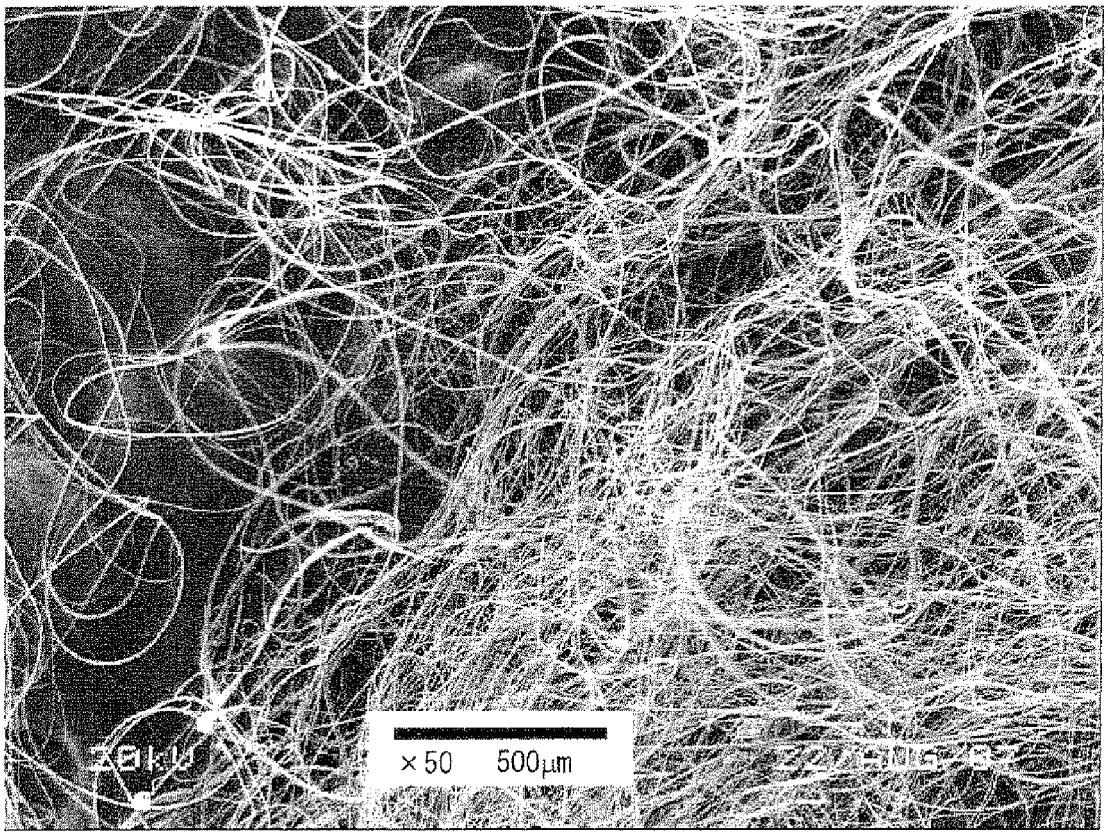
FIG. 5

It should be noted that the concentration of the solvent with respect to the solid content of the fibrous polymeric resin before drying was 100% by mass. FIG. 5 shows an electron micrograph of the resultant polyimide fibers. The resultant fibrous substances were composed of tangled but independent fibers, some of which were curved. The resultant fibrous substances had an average diameter of 3.4 μm, and an assembly of these fibers had a bulk density of 5.0 kg/m$^3$.

Further, the fiber assembly was nearly equal in thermal insulating performance and sound absorbency (see Table 1) to the comparative material.

Example 3

The same operation was performed as in Example 1, except that the polymeric resin solution (A-1) was replaced by the polymeric resin solution (A-3) obtained in Example of Synthesis 3.

Figure 6:
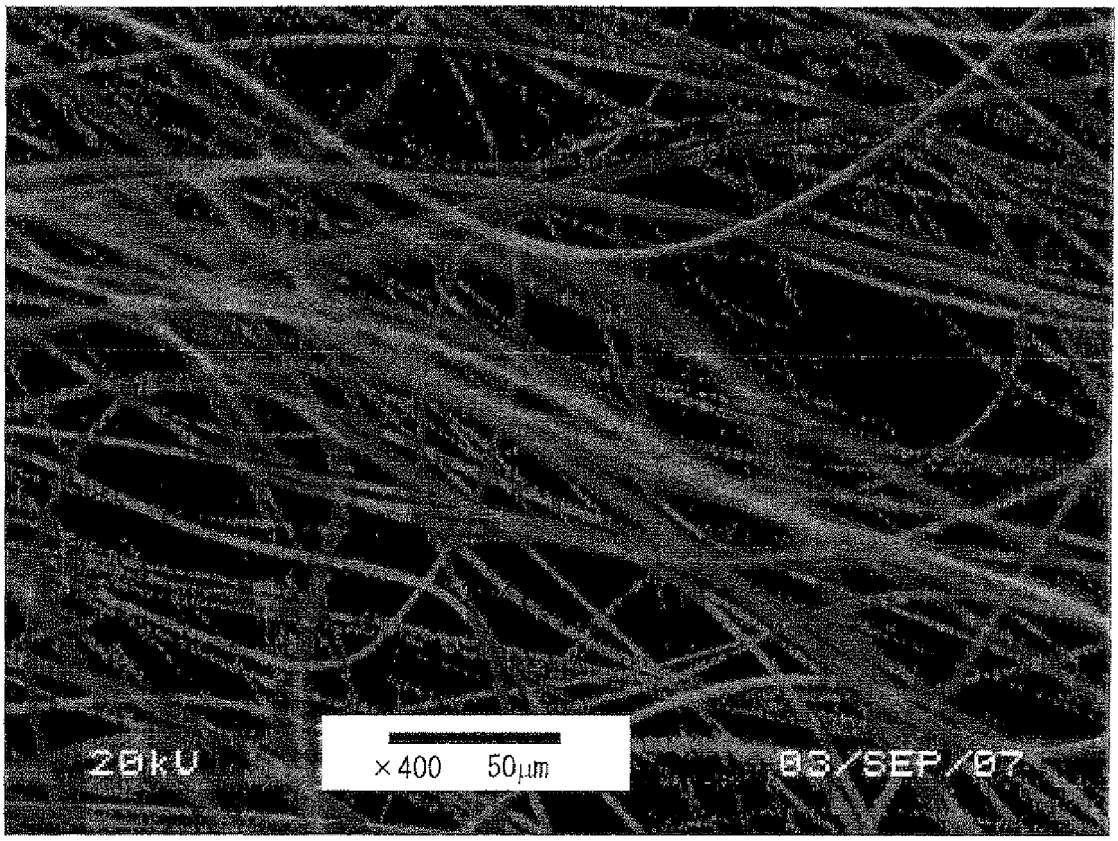
FIG. 6

It should be noted that the concentration of the solvent with respect to the solid content of the fibrous polymeric resin before drying was 75% by mass. FIG. 6 shows an electron micrograph of the resultant polyimide fibers. The resultant fibrous substances were composed of tangled but independent fibers, some of which were curved. The resultant fibrous substances had an average diameter of 2.1 μm, and an assembly of these fibers had a bulk density of 4.5 $kg/m^3$.

Further, the fiber assembly was nearly equal in thermal insulating performance and sound absorbency (see Table 1) to the comparative material.

Example 4

The polymeric resin solution (A-3) obtained in Example of Synthesis 3 was spun with use of the apparatus of FIG. 1 under the following conditions:

Orifice: 0.7 mm in diameter; circle in shape; one-hole

Discharge rate: 0.6 g/min/hole

Distance between the orifice and the airflow generating device: 40 cm

Type of gas to be blown: air

Angle of intersection of the airflow: 100 degrees

Temperature of the airflow: 25° C.

Velocity of wind from the airflow generating device: 12 m/sec

Flying distance of the polymeric resin solution: 2 m

The resulting polymeric resin was caught in a catching net for five hours. Thus obtained was a fibrous polymeric resin composed of polyamic acid. The concentration of the solvent with respect to the solid content of the polymeric resin was 90% by mass.

Figure 7:
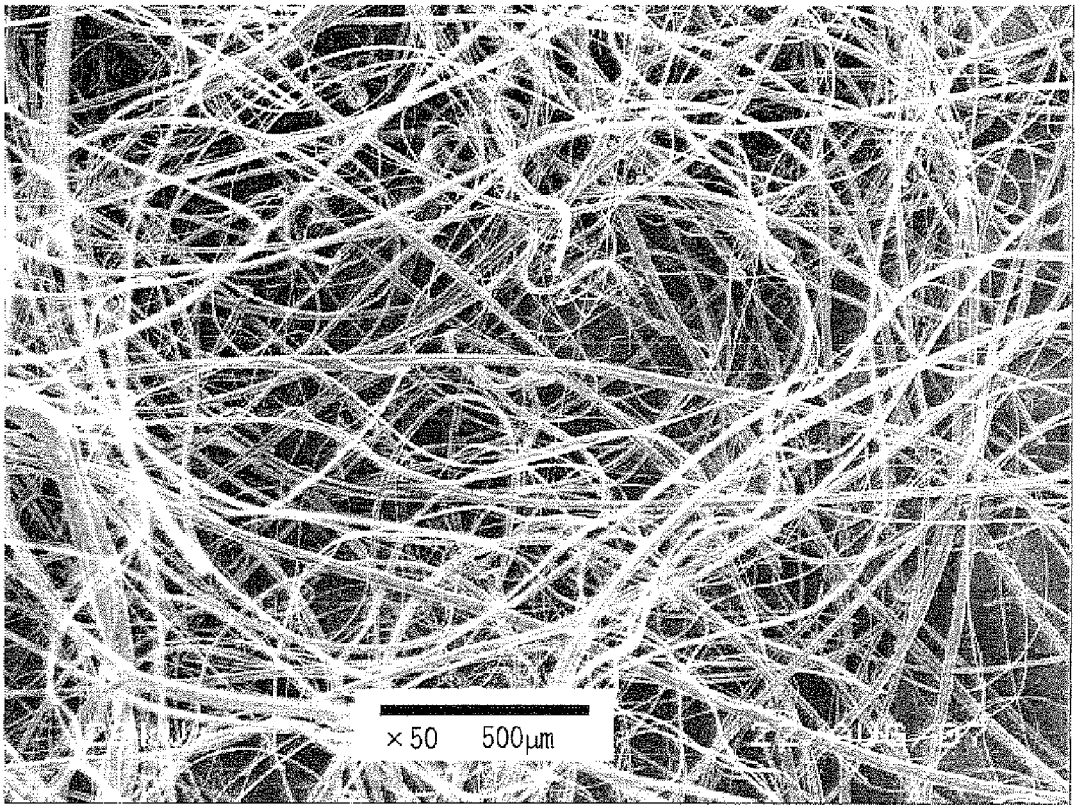
FIG. 7

The fibrous substances were collected and put into an oven heated to 100° C., and the oven was heated to 420° C. over one hour. The fibrous substances were calcined for five minutes at 420° C. to give polyimide fibers. FIG. 7 shows an electron micrograph of the polyimide fibers. The resultant fibrous substances were composed of tangled but independent fibers, some of which were curved. The resultant fibrous substances had an average diameter of 8.8 μm, and an assembly of these fibers had a bulk density of 12.0 $kg/m^3$.

Further, the fiber assembly was nearly equal in thermal insulating performance and sound absorbency (see Table 1) to the comparative material.

Example of Synthesis 4

A reaction was induced in a reaction apparatus prepared by attaching, into a two-liter glass separable flask whose internal gas had been replaced by nitrogen, a stirring blade for stirring a solution. First, a solution obtained by dissolving 18.0 g (0.09 mol) of 4,4'-ODA and 86.3 g (0.21 mol) of BAPP in 769 g of DMF was kept warm at 40° C. Into this solution, 65.5 g (0.30 mol) of PMDA was poured, which was then completely dissolved. To this solution, a solution obtained by dissolving 0.33 g of PMDA in 4.18 g of DMF was added in small portions. The addition was stopped at the point of time where the viscosity of the solution became 1,860 P at 23° C. Thus obtained was a polymeric resin solution (B-1) for use in spinning.

The viscosity of this solution at 23° C. was measured by using a type B viscometer at 10 rpm and 2 rpm, whereby the thixotropic index was calculated to be 1.07. The solid content concentration was 18% by mass.

A polyimide film was produced from this polyimide resin, and the temperature at which the storage modulus of elasticity drops was measured and found to be 305° C.

Example of Synthesis 5

A reaction was induced in a reaction apparatus prepared by attaching, into a two-liter glass separable flask whose internal gas had been replaced by nitrogen, a stirring blade for stirring a solution. First, a solution obtained by dissolving 60.1 g (0.300 mol) of 4,4'-ODA in 670 g of DMF was kept warm at 30° C. Into this solution, 87.9 g (0.299 mol) of BPDA was poured, which was then completely dissolved. To this solution, a slurry solution obtained by dispersing 0.44 g of BPDA in 5.81 g of DMF was added in small portions. The addition was stopped at the point of time where the viscosity of the solution became 1,660 P at 23° C. Thus obtained was a polymeric resin solution (B-2) for use in spinning.

The viscosity of this solution at 23° C. was measured by using a type B viscometer at 10 rpm and 2 rpm, whereby the thixotropic index was calculated to be 1.01. The solid content concentration was 18.0% by mass. A polyimide film was produced from this polyimide resin, and the storage modulus of elasticity was measured, whereby the temperature at which the storage modulus of elasticity drops was found to be 303° C.

Example 5

The polymeric resin solution (A-1) obtained in Example of Synthesis 1 and the fusible polymeric resin solution (B-1) obtained in Example of Synthesis 4 were spun with use of the apparatus of FIG. 1.

Figure 9:
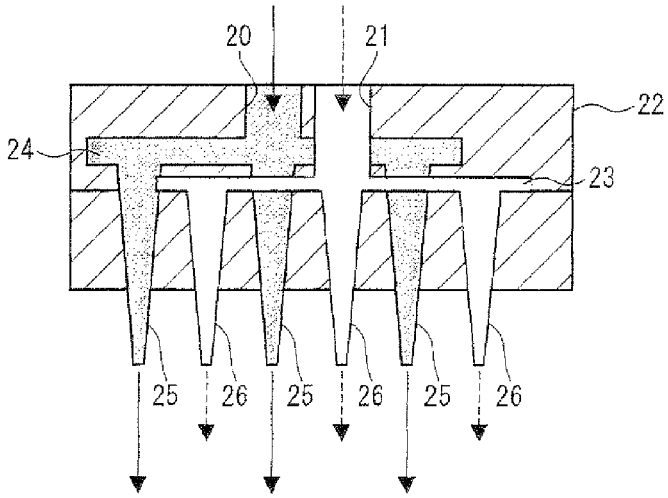
FIG. 9

It should be noted that as in the case of a die shown in FIG. 9, the spinneret includes orifices 25 through which to discharge the polymeric resin solution (A-1) of Example of Synthesis 1 and orifices 26 through which to discharge the polymeric resin solution (B-1) of Example of Synthesis 4. That is, the die used was a die in which the solutions are discharged through different outlets.

The polymeric resin solution (A-1) is injected through an inlet 20 and divided by a branching channel 24 to be discharged through each separate orifice 25. Further, the polymeric resin solution (B-1) is injected through an inlet 21 and divided by a branching channel 23 to be discharged through each separate orifice 26.

It should be noted that the spinning was performed under the following conditions:

Orifices through which to discharge the polymeric resin solution (A-1): 0.2 mm in diameter; circle in shape; eight-hole Discharge rate of the polymeric resin solution (A-1): 0.020 g/min/hole Orifices through which to discharge the polymeric resin solution (B-1): 0.2 mm in diameter; circle in shape; one-hole Discharge rate of the polymeric resin solution (B-1): 0.030 g/min/hole Distance between the orifices and the airflow generating device: 15 cm Type of gas to be blown: air Angle of intersection of the airflow: 93 degrees Temperature of the airflow: 26° C.

Velocity of wind from the airflow generating device: 13.4 m/sec

Flying distance of the polymeric resin solution: 2.5 m

The resulting polymeric resin was caught in a catching net for five hours. Thus obtained was a fibrous polymeric resin composed of polyamic acid. The concentration of the solvent with respect to the solid content of the polymeric resin was 15% by mass.

Figure 10:
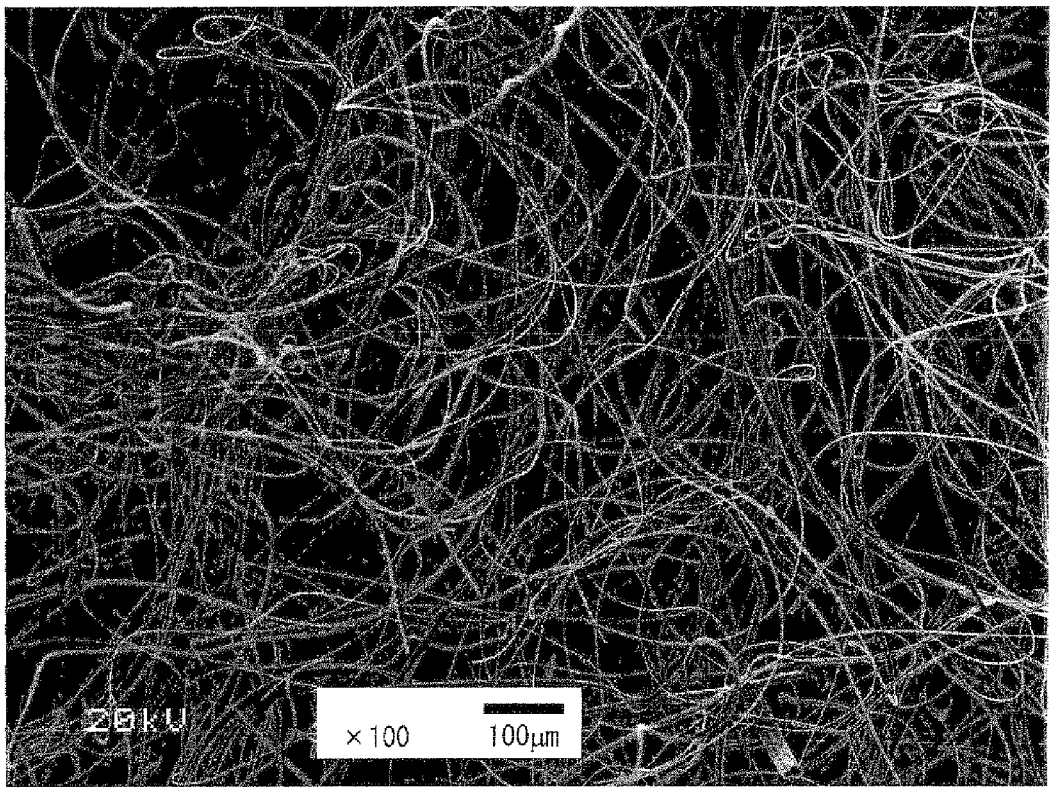
FIG. 10
Figure 11:
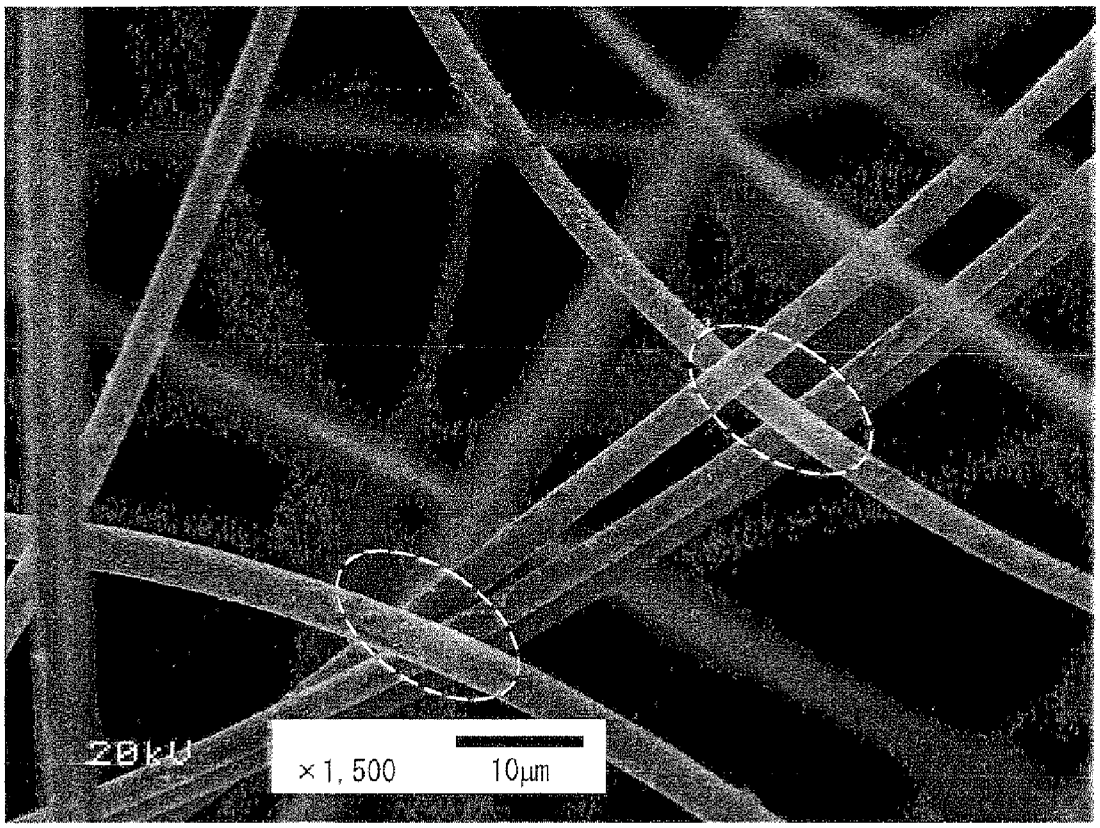
FIG. 11

The fibrous substances were collected and put into an oven heated to 100° C. and dried for three minutes, and the oven was heated to 420° C. over one hour. The fibrous substances were calcined for five minutes at 420° C. to give an assembly of polyimide fibers. FIGS. 10 and 11 show electron micrographs of the polyimide fibers.

The resultant polyimide fiber assembly was composed of tangled fibers, some of which were curved, and the fibers were fused with each other as in the sites encircled by the dotted lines in FIG. 11. The resultant fibrous substances had an average diameter of 3.9 μm, and an assembly of these fibers had a bulk density of 8.0 kg/m$^3$.

Further, the fiber assembly was nearly equal in thermal insulating performance and sound absorbency (see Table 1) to the comparative material.

Example 6

The polymeric resin solution (A-1) obtained in Example of Synthesis 1 and the fusible polymeric resin solution (B-2) obtained in Example of Synthesis 5 were spun with use of the apparatus of FIG. 1.

It should be noted, as in Example 5, that as in the case of a die shown in FIG. 9, the spinneret includes orifices 25 through which to discharge the polymeric resin solution (A-1) of Example of Synthesis 1 and orifices 26 through which to discharge the polymeric resin solution (B-2) of Example of Synthesis 5. That is, the die used was a die in which the solutions are discharged through different outlets.

It should be noted that the spinning was performed under the following conditions:

Orifices through which to discharge the polymeric resin solution (A-1): 0.2 mm in diameter; circle in shape; four-hole Discharge rate of the polymeric resin solution (A-1): 0.009 g/min/hole Orifices through which to discharge the polymeric resin solution (B-2): 0.2 mm in diameter; circle in shape; two-hole Discharge rate of the polymeric resin solution (B-2): 0.014 g/min/hole Distance between the orifices and the airflow generating device: 15 cm Type of gas to be blown: air Angle of intersection of the airflow: 93 degrees Temperature of the airflow: 26° C.

Velocity of wind from the airflow generating device: 12.0 m/sec

Flying distance of the polymeric resin solution 2.5 m

The resulting polymeric resin was caught in a catching net for five hours. Thus obtained was a fibrous polymeric resin composed of polyamic acid. The concentration of the solvent with respect to the solid content of the polymeric resin was 20% by mass.

Figure 12:
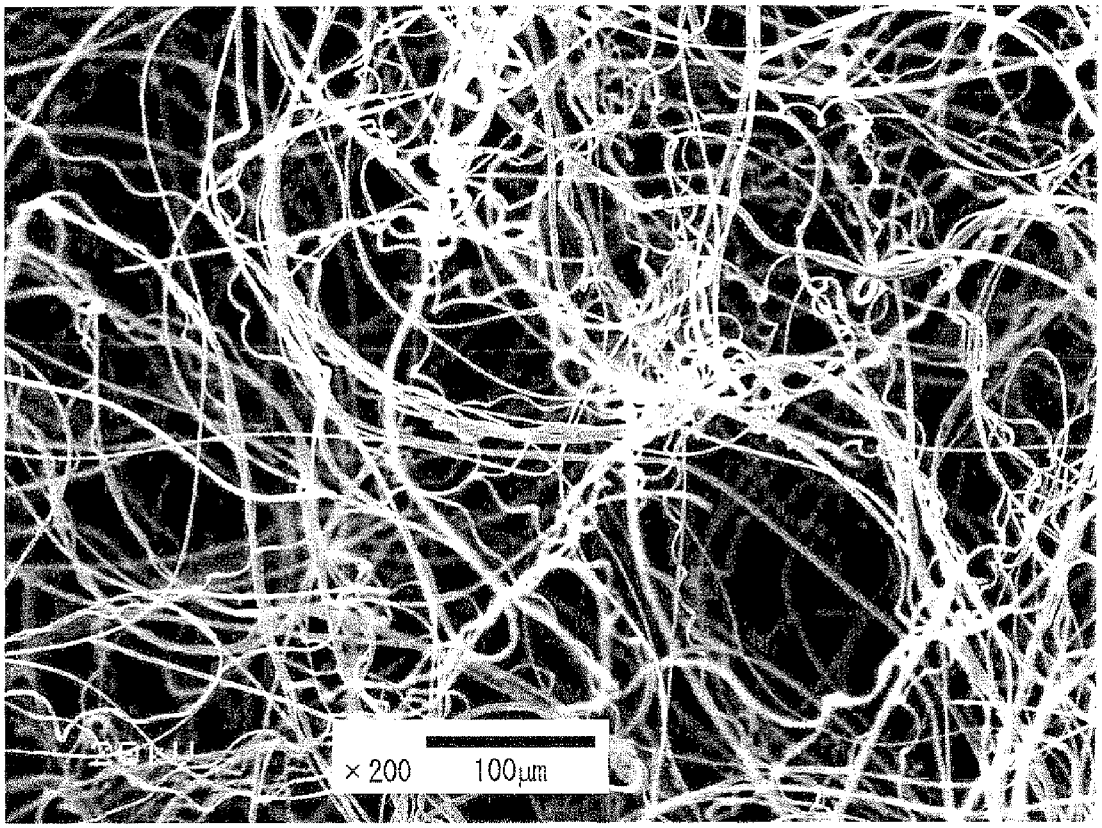
FIG. 12
Figure 13:
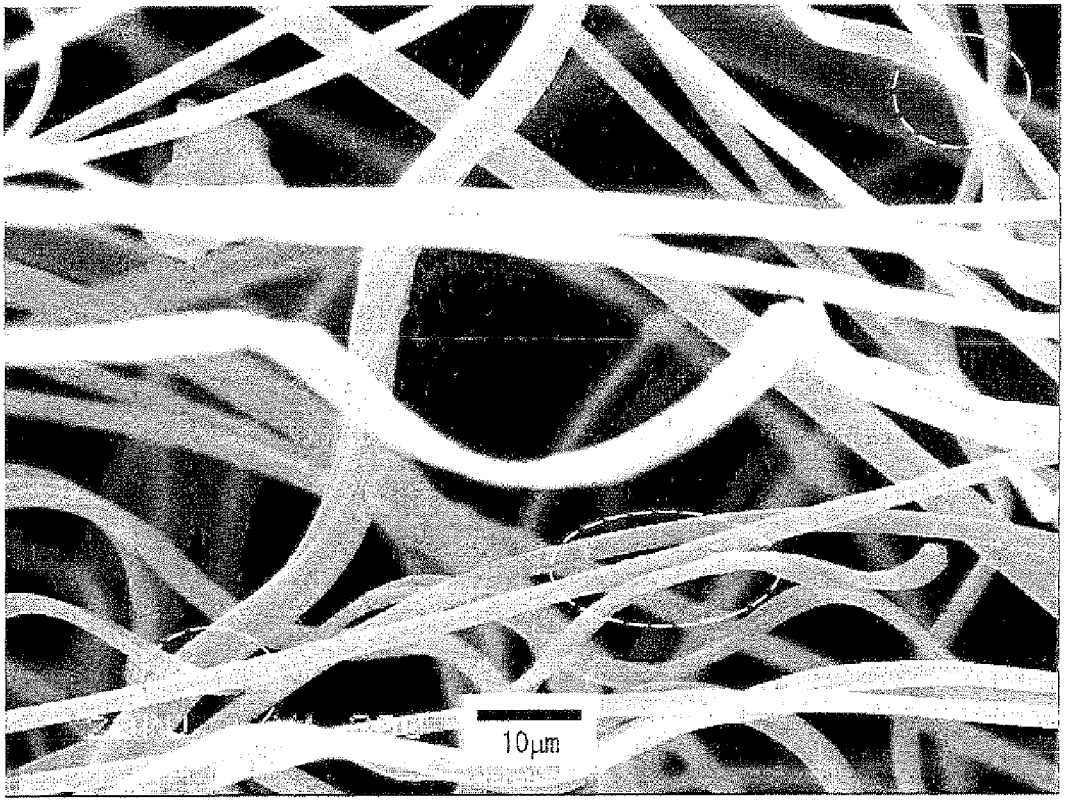
FIG. 13

The fibrous substances were collected and put into an oven heated to 100° C. and dried for three minutes, and the oven was heated to 420° C. over one hour. The fibrous substances were calcined for five minutes at 420° C. to give an assembly of polyimide fibers. FIGS. 12 and 13 show electron micrographs of the polyimide fibers.

The resultant polyimide fiber assembly was composed of tangled fibers, some of which were curved, and the fibers were fused with each other as in the sites encircled by the dotted lines in FIG. 13. The resultant fibrous substances had an average diameter of 2.6 μm, and an assembly of these fibers had a bulk density of 3.7 kg/m$^3$.

Further, the fiber assembly was nearly equal in thermal insulating performance and sound absorbency (see Table 1) to the comparative material.

Comparative Example 1

The polymeric resin solution (A-1) was spun with use of the apparatus of FIG. 1 under the following conditions:

Orifice: 2.0 mm in diameter; circle in shape; one-hole

Discharge rate of the polymeric resin solution: 2.0 g/min/hole

Distance between the orifice and the airflow generating device: 40 cm

Type of gas to be blown: air

Angle of intersection of the airflow: 100 degrees

Temperature of the airflow: 25° C.

Velocity of wind from the airflow generating device: 15 m/sec

Flying distance of the polymeric resin solution: 2 m

The resulting polymeric resin was caught in a catching net for five hours. Thus obtained was a fibrous polymeric resin composed of polyamic acid. The concentration of the solvent with respect to the solid content of the polymeric resin was 80% by mass.

The fibrous substances were collected and put into an oven heated to 100° C., and the oven was heated to 420° C. over one hour. The fibrous substances were calcined for five minutes at 420° C. to give polyimide fibers. The resultant fibrous substances had an average diameter of 110 μm, and an assembly of these fibers had a bulk density of 35 kg/m$^3$. However, the fiber assembly was inferior in thermal insulating performance and sound absorbency (see Table 1) to the comparative material.

TABLE 1

| Items evaluated | | Example 1 | Example 2 | Example 3 | Example 4 | Example 5 | Example 6 | Comparative Material | Comparative Example 1 |
|---|---|---|---|---|---|---|---|---|---|
| Average fiber diameter (μm) | | 4.0 | 3.4 | 2.1 | 8.8 | 3.9 | 2.6 | 1.0 | 110 |
| Bulk density (kg/m$^3$) | | 7.0 | 5.0 | 4.5 | 12.0 | 8.0 | 3.7 | 5.5 | 35 |
| Sound absorption coefficient | 500 Hz | 0.148 | 0.156 | 0.118 | 0.150 | 0.144 | 0.140 | 0.148 | 0.145 |
| | 630 Hz | 0.192 | 0.159 | 0.157 | 0.198 | 0.188 | 0.156 | 0.171 | 0.166 |
| | 800 Hz | 0.249 | 0.185 | 0.209 | 0.266 | 0.225 | 0.212 | 0.219 | 0.189 |
| | 1000 Hz | 0.337 | 0.300 | 0.287 | 0.360 | 0.281 | 0.256 | 0.283 | 0.214 |
| | 1250 Hz | 0.447 | 0.399 | 0.392 | 0.479 | 0.362 | 0.349 | 0.369 | 0.260 |
| | 1600 Hz | 0.581 | 0.519 | 0.517 | 0.616 | 0.467 | 0.461 | 0.506 | 0.314 |
| | 2000 Hz | 0.724 | 0.687 | 0.657 | 0.757 | 0.599 | 0.696 | 0.656 | 0.413 |

TABLE 1-continued

| Items evaluated | Example 1 | Example 2 | Example 3 | Example 4 | Example 5 | Example 6 | Comparative Material | Comparative Example 1 |
|---|---|---|---|---|---|---|---|---|
| 2500 Hz | 0.844 | 0.778 | 0.783 | 0.870 | 0.725 | 0.775 | 0.798 | 0.470 |
| 3150 Hz | 0.933 | 0.891 | 0.887 | 0.950 | 0.845 | 0.916 | 0.913 | 0.541 |
| 4000 Hz | 0.979 | 0.952 | 0.954 | 0.984 | 0.932 | 0.983 | 0.972 | 0.633 |
| 5000 Hz | 0.980 | 0.952 | 0.976 | 0.975 | 0.967 | 0.994 | 0.978 | 0.666 |
| 6300 Hz | 0.961 | 0.967 | 0.970 | 0.950 | 0.959 | 0.975 | 0.960 | 0.654 |
| Photographs of fibers | FIG. 4 | FIG. 5 | FIG. 6 | FIG. 7 | FIGS. 10 and 11 | FIGS. 12 and 13 | NA | NA |

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

A polyimide fiber assembly of the present invention includes polyimide fibers having curved shapes with an average fiber diameter falling within a range of greater than 1 μm to not greater than 100 μm, the polyimide fiber assembly having a bulk density falling within a range of not less than 1 kg/m$^3$ to not greater than 30 kg/m$^3$. As such, the polyimide fiber assembly can be used as a sound-absorbing material, a thermal insulating material, various filters, a diaphragm for use in electrolytic battery, a separator for use in storage battery, fuel-cell component dialyzing membrane, a lining material for use in medical prosthesis, and an immobilization support for use in cell culture or bioreactor.

The invention claimed is:

1. A method of making a polyimide fiber assembly comprising polyimide fibers comprising curved shapes with an average fiber diameter falling within a range of greater than 1 μm to not greater than 100 μm, said polyimide fiber assembly comprising a bulk density falling within a range of not less than 1 kg/m$^3$ to not greater than 30 kg/m$^3$, comprising the steps of:

(i) discharging, through an orifice of a spinneret, a polymeric resin solution obtained by dissolving polyamic acid or polyimide in an organic solvent; and (ii) blowing gas onto the polymeric resin solution, which has been discharged through the orifice, from only one air nozzle from a single direction with respect to a direction of discharge of the polymeric resin solution so that the gas intersects with a flow of the polymeric resin solution, and using external force to cause the polymeric resin solution thus discharged through the orifice of a spinneret, to fly in a direction of the external force, the external force being external force of gas from a direction intersecting with a discharge direction in which the polymeric resin solution is discharged, and then forming a polymeric resin into fibers by spinning while vaporizing the organic solvent contained in the polymeric resin solution, the air nozzle and the orifice being provided separately without contacting each other, an angle between the discharge direction in which the polymeric resin solution is discharged and the direction of the gas from the air nozzle falling within a range of not less than 30 degrees to not greater than 150 degrees, a flow velocity of the gas that is discharged from the air nozzle is within a range of not less than 10 m/sec to not greater than 300 m/sec.

2. The method as set forth in claim 1, wherein the angle falls within a range of not less than 93 degrees to not greater than 150 degrees.

* * * * *